US010403451B2

(12) United States Patent
Ito et al.

(10) Patent No.: US 10,403,451 B2
(45) Date of Patent: Sep. 3, 2019

(54) PUSHBUTTON SWITCH MEMBER

(71) Applicant: SHIN-ETSU POLYMER CO., LTD., Tokyo (JP)

(72) Inventors: Masayuki Ito, Shiojiri (JP); Satoru Kitazawa, Shiojiri (JP); Kenichi Miyajima, Shiojiri (JP); Kazunobu Yokoyama, Shiojiri (JP); Tadashi Hayashi, Shiojiri (JP)

(73) Assignee: Shin-Etsu Polymer Co., Ltd. (JP)

( * ) Notice: Subject to any disclaimer, the term of this patent is extended or adjusted under 35 U.S.C. 154(b) by 0 days.

(21) Appl. No.: 15/738,472

(22) PCT Filed: Jun. 17, 2016

(86) PCT No.: PCT/JP2016/068034
§ 371 (c)(1),
(2) Date: Dec. 20, 2017

(87) PCT Pub. No.: WO2016/208499
PCT Pub. Date: Dec. 29, 2016

(65) Prior Publication Data

US 2018/0190445 A1 Jul. 5, 2018

(30) Foreign Application Priority Data

Jun. 25, 2015 (JP) ..... 2015-127348
Mar. 24, 2016 (JP) ..... 2016-059707

(51) Int. Cl.
*H01H 13/14* (2006.01)
*H01H 13/02* (2006.01)
(Continued)

(52) U.S. Cl.
CPC ..... *H01H 13/14* (2013.01); *H01H 13/023* (2013.01); *H01H 13/26* (2013.01);
(Continued)

(58) Field of Classification Search
CPC ..... H01H 13/14; H01H 13/02; H01H 13/26; H01H 13/66
(Continued)

(56) References Cited

U.S. PATENT DOCUMENTS 5,152,392 A 10/1992 Iwasa
5,924,555 A 7/1999 Sadamori et al.
(Continued)

FOREIGN PATENT DOCUMENTS

JP 1972-071099 U 6/1972
JP H04-47616 A 2/1992
(Continued)

*Primary Examiner* — Edwin A. Leon
*Assistant Examiner* — Iman Malakooti
(74) *Attorney, Agent, or Firm* — Harness, Dickey & Pierce, P.L.C.

(57) ABSTRACT

A pushbutton switch member has a dome-shaped movable contact and an operation key facing and separated from a movable contact. Pushing the operation key toward the movable contact causes the movable contact to electrically connect at least two contacts on a substrate. The operation key is provided with: a key; a dome connected with an outer periphery of the key, and deformable by pushing of the key toward the substrate; and a foot connected with an outer periphery of the dome, and fixed on the substrate. The movable contact is provided with: an upper contact spaced apart from a site directly below the key, and which makes contact with a contact when the key is pushed in; and an outer fixing part disposed at the upper contact, or further outside thereof in the radial direction, and fixed outside of the key in the radial direction.

15 Claims, 26 Drawing Sheets

Line D-D cross sectional view

(51) Int. Cl.

| | |
|---|---|
| ***H01H 13/26*** | (2006.01) |
| ***H01H 13/48*** | (2006.01) |
| ***H01H 13/52*** | (2006.01) |
| *H01H 13/66* | (2006.01) |

(52) U.S. Cl.
CPC ..... *H01H 13/48* (2013.01); *H01H 13/52* (2013.01); *H01H 13/66* (2013.01); *H01H 2215/006* (2013.01)

(58) Field of Classification Search
USPC ..... 200/512
See application file for complete search history.

(56) References Cited

U.S. PATENT DOCUMENTS

| | | | | |
|---|---|---|---|---|
| 6,984,799 | B2 * | 1/2006 | Kawaguchi ..... | H01H 9/182 200/314 |
| 7,485,824 | B2 | 2/2009 | Rastemborski et al. | |
| 2003/0094359 | A1 | 5/2003 | Yanai et al. | |
| 2004/0158975 | A1 | 8/2004 | Kawaguchi et al. | |
| 2005/0259382 | A1 * | 11/2005 | Ducruet ..... | H01H 13/48 361/600 |
| 2006/0081452 | A1 * | 4/2006 | Yanai ..... | H01H 13/14 200/406 |
| 2007/0039811 | A1 * | 2/2007 | Yanai ..... | H01H 13/48 200/406 |
| 2014/0090967 | A1 | 4/2014 | Inagaki | |
| 2014/0097073 | A1 | 4/2014 | Kikuchi | |

FOREIGN PATENT DOCUMENTS

| | | | | | |
|---|---|---|---|---|---|
| JP | H05-033422 | U | | 4/1993 | |
| JP | H08-298043 | A | | 11/1996 | |
| JP | H10-188728 | A | | 7/1998 | |
| JP | H11-339593 | A | | 12/1999 | |
| JP | 2005-032705 | A | | 2/2005 | |
| JP | 2006-120397 | A | | 5/2006 | |
| JP | 2007-052962 | A | | 3/2007 | |
| JP | 2010-146737 | | * | 7/2010 | ..... H01H 13/48 |
| JP | 2010-146737 | A | | 7/2010 | |
| JP | 3179036 | | * | 10/2012 | ..... H01H 13/14 |
| JP | 3179036 | U | | 10/2012 | |
| WO | WO-2012-153587 | A1 | | 11/2012 | |

* cited by examiner

Line C-C cross sectional view

Line D-D cross sectional view

Line G-G cross sectional view

PUSHBUTTON SWITCH MEMBER

CROSS REFERENCE

The present application claims the benefit of priorities of Japanese Patent Application No. 2015-127348, filed on Jun. 25, 2015 in Japan and Japanese Patent Application No. 2016-59707, filed on Mar. 24, 2016 in Japan, the entire contents of which are incorporated herein by reference. The entire contents of patents, patent applications, and literatures cited in the present application are also incorporated herein by reference.

TECHNICAL FIELD

The present invention relates to a pushbutton switch member.

RELATED ART

In a conventionally known pushbutton switch member, a switch is turned on through deformation of a metal dome when pushing is externally applied on a central top part of the metal dome (see Japanese Patent Laid-open No. 10-188728, for example). Along with downsizing of keys and spaces therebetween due to recent downsizing of an instrument in which a pushbutton switch member is incorporated, it has been increasingly required to highly accurately achieve positioning between each key and the metal dome. When a positional difference occurs between a pushing position on the key and the central top part of the metal dome, a favorable click feeling cannot be obtained. To solve such a problem, a pushbutton switch member has been developed in which the central top part of the metal dome is adhered directly below the key (see Japanese Patent Laid-open No. 2007-52962, for example). When the metal dome is connected directly below the key, the positions of the key and the metal dome are fixed so that the central top part of the metal dome can be reliably pushed, and thus a favorable click feeling can be obtained, which is advantageous.

In particular, a circuit board is provided with a first fixed contact configured to contact with the center of the metal dome, and a second fixed contact configured to contact with the outer periphery of the metal dome, and the metal dome is connected with the key while floating above the circuit board. This configuration achieves such a two-staged switch that, when the metal dome is pushed down through the key, the outer periphery of the metal dome contacts with the second fixed contact to turn on a switch, and subsequently, a central part of the metal dome contacts with the first fixed contact to turn on another switch (see WO 2012/153587, for example).

However, the conventionally known pushbutton switch member described above has the following problems. The pushbutton switch member disclosed in JP 10-188728 has a problem that, when the metal dome is pushed alone, a stroke until a peak load is reached since start of the pushing is short. As a result, an ergonomically natural operation feeling cannot be obtained, and an operator is likely to feel discomfort. The pushbutton switch member disclosed in JP 10-188728 has another problem that it is difficult to handle a high load. The sheet thickness, diameter, or curvature of the metal dome needs to be increased to achieve a high-load switch with the metal dome alone, which degrades durability against repetitive deformation and increases the size of the switch. In the pushbutton switch member disclosed in JP 10-188728, when a rubber switch is disposed above the metal dome, the above-described problem is reduced, but a positional difference between a pusher on a lower surface of the rubber switch and a top part of the metal dome is likely to occur. This positional difference degrades touch feeling and thus is not preferable. In the pushbutton switch members disclosed in JP 2007-52962 and WO 2012/153587, a pusher directly below the rubber switch is adhered to the top part of the metal dome, and thus the above-described positional difference problem does not occur, but another problem attributable to adhesive agent occurs. The problem is such that dimensional tolerance in a pushing direction is large due to variation in the thickness of the adhesive agent, which makes it difficult to reliably provide a favorable operation feeling. In addition, the metal dome is unlikely to deform where the adhesive agent exists, and thus a strong click feeling that would be otherwise provided by the metal dome is unlikely to be obtained.

The present invention is intended to solve the above-described problems and provide a small pushbutton switch member capable of handling a high load and reliably achieving a long stroke and a strong click feeling.

SUMMARY

To achieve the above-described intention, a pushbutton switch member according to an embodiment is a pushbutton switch member including a dome-shaped movable contact, and an operation key disposed on a protrusion side of the movable contact, the operation key being opposite to and spaced apart from the movable contact. Pushing the operation key toward the movable contact causes the movable contact to electrically connect at least two contacts on a substrate. The operation key includes a key body, a dome part connected with an outer periphery of the key body and deformable by pushing of the key body, and a foot part connected with an outer periphery of the dome part and fixed on the substrate. The movable contact includes an upper contact part spaced apart from a site directly below the key body and configured to contact with a contact of the at least two contacts when the key body is pushed in, and an outer fixing part disposed at the upper contact part or outside of the upper contact part in a radial direction and fixed outside of the key body of the operation key in the radial direction.

In the pushbutton switch member according to another embodiment of the present invention, the movable contact may further include an outer contact part disposed outside of the upper contact part in the radial direction of the movable contact and opposite to another contact of the at least two contacts in a contact or non-contact manner, the other contact being disposed outside of the contact configured to contact with the upper contact part in the radial direction, the outer contact part being configured to contact with the other contact when the key body is pushed in.

In the pushbutton switch member according to another embodiment of the present invention, the operation key may include, between the dome part and the foot part, one or more intermediate parts facing to the substrate with a gap interposed therebetween, and the movable contact may be disposed such that the outer fixing part is fixed to the intermediate part.

In the pushbutton switch member according to another embodiment of the present invention, the outer fixing part may be fixed to the dome part of the operation key.

In the pushbutton switch member according to another embodiment of the present invention, the movable contact may include a first through-hole in a region including a central part in plan view, and contact with the key body at a periphery of the first through-hole when the operation key is pushed in.

In the pushbutton switch member according to another embodiment of the present invention, light may be transmitted through the first through-hole from an illumination means provided inside of the contacts on the substrate in the radial direction.

In the pushbutton switch member according to another embodiment of the present invention, the operation key may include, at a lower part of the key body, a recess in which the illumination means is housed when the key body is moved downward, and at least a portion of the operation key may be translucent.

In the pushbutton switch member according to another embodiment of the present invention, the operation key may include, at the key body, a second through-hole penetrating from outside of the key body toward the movable contact.

In the pushbutton switch member according to another embodiment of the present invention, a translucent material may be buried partially or entirely in the second through-hole in a length direction of the second through-hole.

In the pushbutton switch member according to another embodiment of the present invention, the operation key may be made of a translucent material.

In the pushbutton switch member according to another embodiment of the present invention, a light-shielding layer may be partially provided at least a top surface of the key body.

In the pushbutton switch member according to another embodiment of the present invention, the key body may have such a multi-layer structure that a top surface side of the key body and a movable contact side of the key body are made of materials having different hardness values.

Advantageous Effects of Invention

The present invention provides a small pushbutton switch member capable of handling a high load and reliably achieving a long stroke and a strong click feeling.

DETAILED DESCRIPTION

Embodiments of a pushbutton switch member according to the present invention will be described below with reference to the accompanying drawings. The embodiments described below are not intended to limit the invention according to the claims. Elements and combinations thereof described in the embodiments do not necessarily all essential to solution according to the present invention.

First Embodiment

Figure 1A:
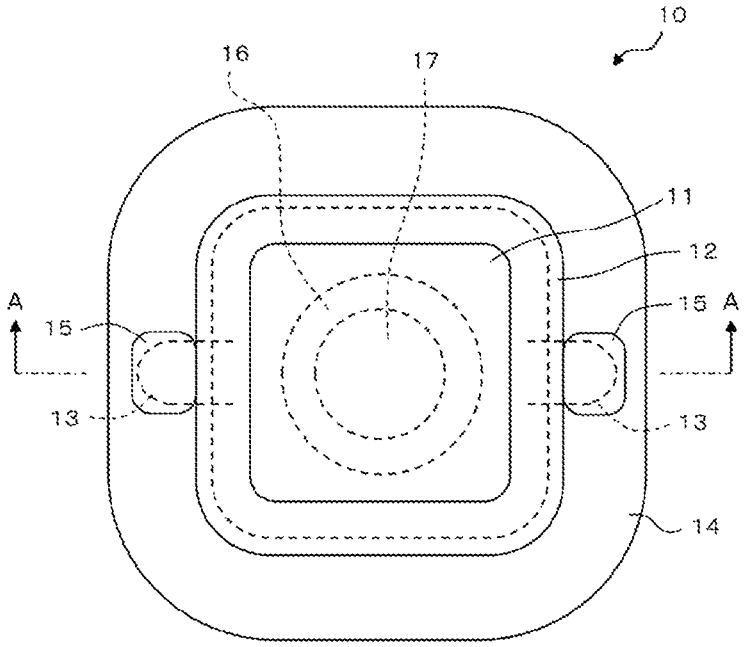
FIGS. 1A and 1B illustrate a transparent plan view (FIG. 1A) of an operation key included in a pushbutton switch member according to a first embodiment and a line A-A cross-sectional view (FIG. 1B) taken along line A-A in this transparent plan view.
Figure 1B:
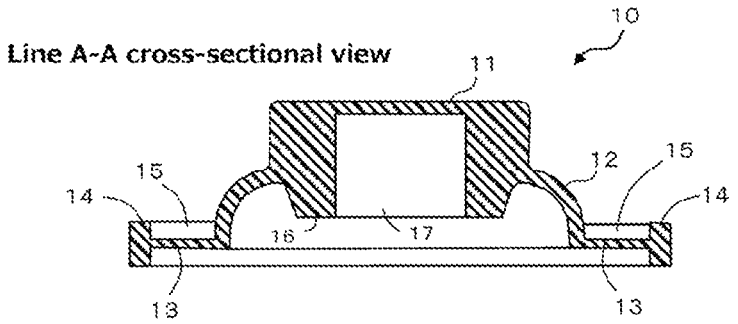
Figure 2A:
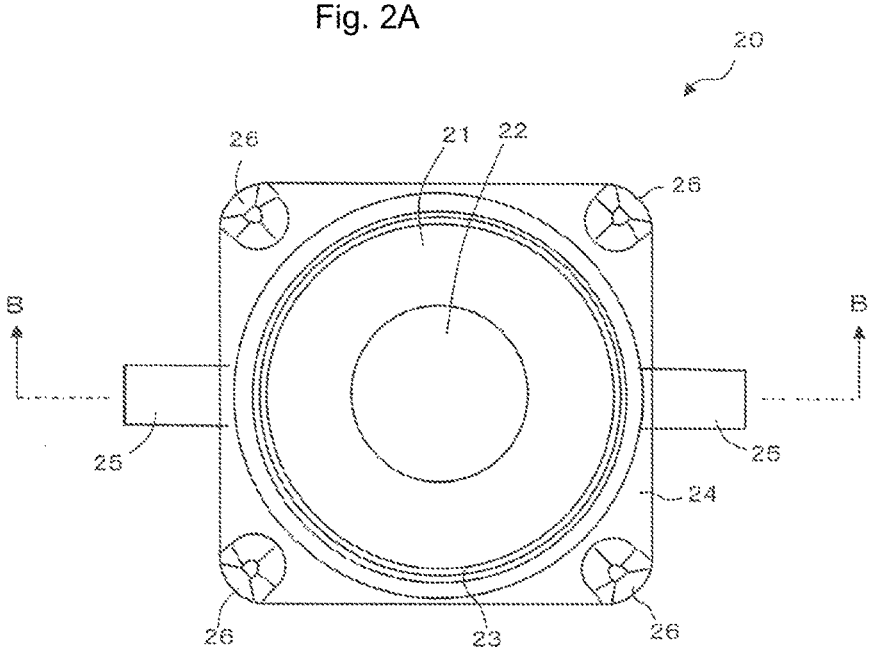
FIGS. 2A and 2B illustrate a plan view (FIG. 2A) of a dome-shaped movable contact included in the pushbutton switch member according to the first embodiment and a line B-B cross-sectional view (FIG. 2B) taken along line B-B in this plan view.
Figure 2B:
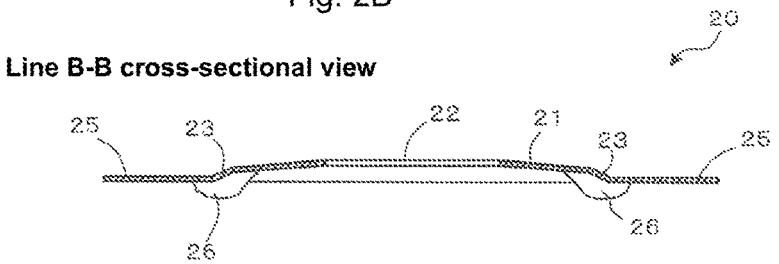
Figure 3A:
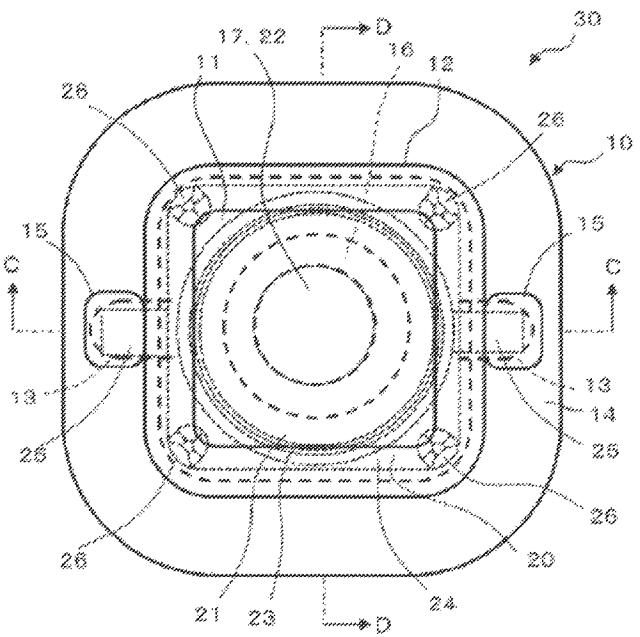
FIG. 3A illustrates a transparent plan view when the pushbutton switch member according to the first embodiment in which the dome-shaped movable contact illustrated in FIG. 2 is fixed below the operation key illustrated in FIG. 1 is disposed on a circuit board.
Figure 3B:
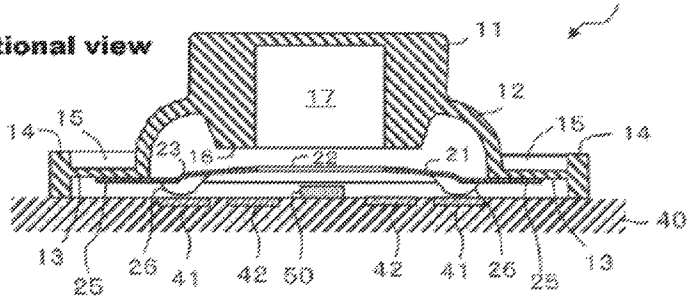
FIG. 3B illustrates a line C-C cross-sectional view taken along line C-C in this transparent plan view.
Figure 3C:
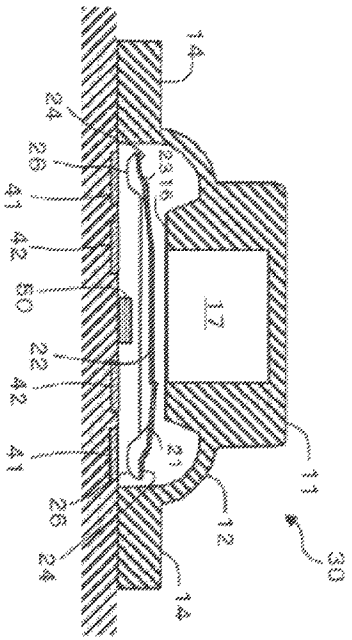
FIG. 3C illustrates a line D-D cross-sectional view taken along line D-D in this transparent plan view.
Figure 4:
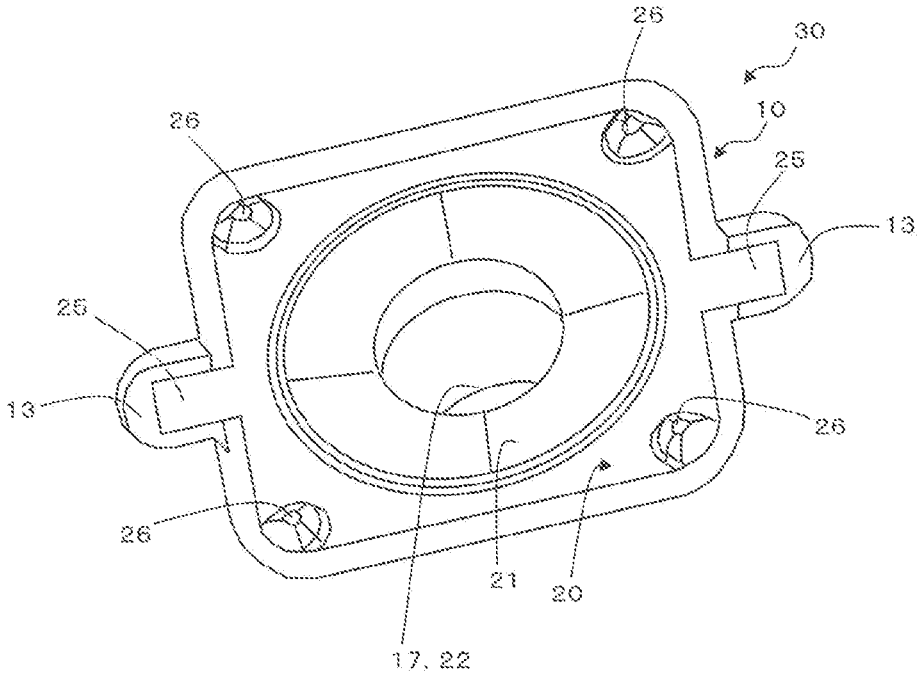
FIG. 4 illustrates a back-surface perspective view of the pushbutton switch member illustrated in FIGS. 3A-3C when obliquely viewed from back.
Figure 5A:
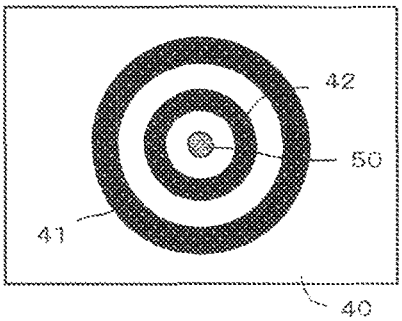
FIGS. 5A-5F illustrate plan views of a substrate illustrated in FIGS. 3A-3C and various modifications thereof.
Figure 5B:
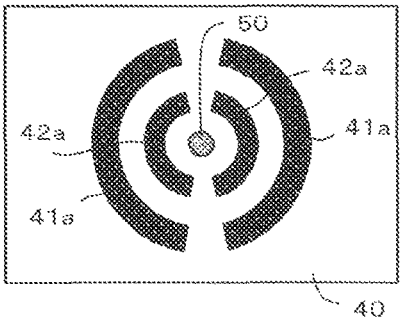
Figure 5C:
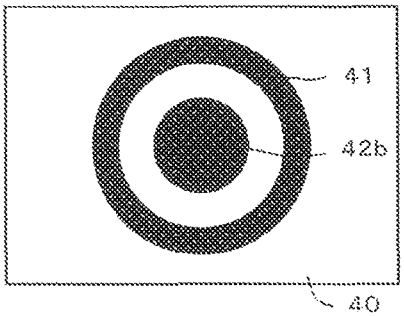
Figure 5D:
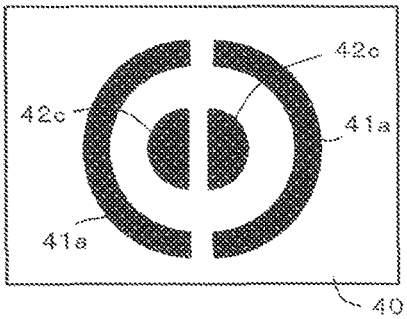
Figure 5E:
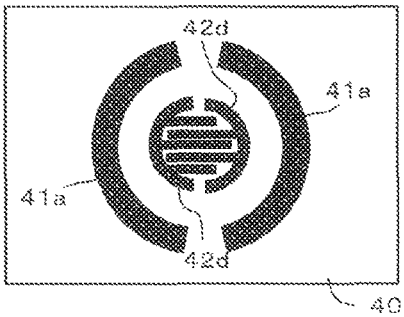
Figure 5F:
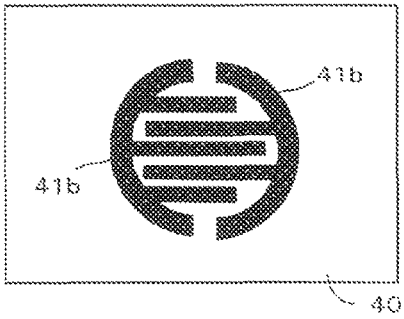

FIG. 1 illustrates a transparent plan view (1A) of an operation key included in a pushbutton switch member according to a first embodiment and a line A-A cross-sectional view (1B) taken along line A-A in this transparent plan view. FIG. 2 illustrates a plan view (2A) of a dome-shaped movable contact included in the pushbutton switch member according to the first embodiment and a line B-B cross-sectional view (2B) taken along line B-B in this plan view. FIG. 3A illustrates a transparent plan view when the pushbutton switch member according to the first embodiment in which the dome-shaped movable contact illustrated in FIG. 2 is fixed below the operation key illustrated in FIG. 1 is disposed on a circuit board. FIG. 3B illustrates a line C-C cross-sectional view taken along line C-C in this transparent plan view, and FIG. 3C illustrates a line D-D cross-sectional view taken along line D-D in this transparent plan view. FIG. 4 illustrates a back-surface perspective view of the pushbutton switch member illustrated in FIGS. 3A-3C when obliquely viewed from back. In the following, "up", "upward", and "upper" means a direction from a substrate toward the pushbutton switch member. "Down", "downward", and "lower" means a direction from the pushbutton switch member toward the substrate. A direction "outward in the radial direction" means a direction in which the radius of a virtual circle about the center of a particular object in plan view increases. A direction "inward in the radial direction" means a direction in which the radius of the above-described virtual circle decreases. "Plan view" means a view from above a surface of the substrate, on which the pushbutton switch member is disposed.

The pushbutton switch member 30 according to the first embodiment includes a dome-shaped movable contact (hereinafter simply referred to as a "movable contact") 20, and an operation key 10 disposed opposite to and spaced apart from a protrusion side of the movable contact 20. Pushing the operation key 10 toward the movable contact 20 causes the movable contact 20 to electrically connect at least two contacts 41 and 42 on a substrate (also referred to as a circuit board) 40.

(1) Operation Key

The operation key 10 includes a key body 11, a dome part 12 connected with the outer periphery of the key body 11 and deformable by pushing of the key body 11 toward the substrate 40, and a foot part 14 connected with the outer periphery of the dome part 12 and fixed on the substrate 40. As illustrated in FIG. 1, the operation key 10 preferably includes, between the dome part 12 and the foot part 14, two intermediate parts 13 facing to the substrate 40 with a gap interposed therebetween. The two intermediate parts 13 are provided at positions facing to each other across a central part of the operation key 10 in plan view, and correspond to sites of connection with the movable contact 20. The operation key 10 includes a downward recess 15 above each intermediate part 13. Thus, the intermediate part 13 has a thickness smaller than the length (thickness) of the foot part 14 in the up-down direction. The movable contact 20 is adhered to a band part 25 to be described later at the intermediate part 13 corresponding to each recess 15. When the operation key 10 is pushed, the dome part 12 gradually deforms, and accordingly, a downward deformation force, and a force for deforming the foot part 14 outside in X and Y directions are exerted. Since the intermediate parts 13 are thin enough to allow easy extension and deformation with weak force, stress applied to fixing parts of the movable contact 20 can be reduced, and as a result, downward stress and outward pulling force on the movable contact 20 can be reduced. In the present embodiment, the recesses 15 are provided to achieve the thin intermediate parts 13, and a clearance (thin film part of the intermediate parts 13) is provided between each band part 25 of the movable contact and the foot part 14. However, the recesses 15 are not essential. For example, when a switch is turned on with a load larger than that of pushing deformation of the movable contact 20, the pushbutton switch member 30 is produced in accordance with this usage by another means such as change of the thickness of the dome part 12. Examples of this means include change of the thickness of the dome part 12 and formation of the recess 15, change of the thickness of the dome part 12 and no formation of the recess 15, and no change of the thickness of the dome part 12 and no formation of the recess 15.

The key body 11 has a substantially rectangular parallelepiped shape and is supported to be floating above the substrate 40 by the dome part 12. The key body 11 includes, substantially at a lower central part in plan view, a pusher 16 protruding in a substantially cylindrical shape toward the substrate 40. The operation key 10 includes, at a lower part of the key body 11 (the position of the pusher 16), a recess 17 in which an illumination means to be described later is housed when the key body 11 is moved downward. The recess 17 is recessed upward substantially at a central part of a lower surface of the pusher 16. The recess 17 has an area smaller than that of the lower surface of the pusher 16. The recess 17 has a bottom surface near an upper surface of the key body 11 but does not penetrate through the key body 11. The dome part 12 has a rectangular tubular shape penetrating from the key body 11 side to the substrate 40 side, and has a larger diameter toward the substrate 40 side. The dome part 12 is made of a thin elastic material designed such that the dome part 12 deforms halfway through the process of pushing down the key body 11 toward the substrate 40 and then returns to the original shape when the push is canceled. In the present embodiment, the entire operation key 10 including the dome part 12 is made of an elastic material, but only the dome part 12 may be made of an elastic material. The foot part 14 is a thin plate shaped in such a rectangle (including a square) in plan view that a part other than the intermediate parts 13 is allowed to contact with the substrate 40.

The operation key 10 is preferably made of thermosetting elastomer such as silicone rubber, urethane rubber, isoprene rubber, ethylene propylene rubber, natural rubber, ethylene propylene diene rubber, or styrene butadiene rubber; thermoplastic elastomer such as urethane series, ester series, styrene series, olefin series, butadiene series, or fluorine series; or any compound thereof. Examples of the material of the operation key 10 other than the above-described materials include styrene butadiene rubber (SBR) and nitrile rubber (NBR). The above-described materials may be mixed with a filler such as titanium oxide or carbon black. At least a portion of the operation key 10 is translucent so that light emitted by an LED (exemplary illumination means) 50 on the substrate 40 is transmitted out of the operation key 10. When the entire operation key 10 is made of a translucent material such as silicone rubber, light from the LED 50 can be transmitted through an optional place of the operation key 10. When the operation key 10 is made of a low translucent material, the bottom surface of the recess 17 and the upper surface of the key body 11 can be formed to have such small thicknesses that light from the LED 50 is transmitted only toward the recess 17.

(2) Movable Contact

The movable contact 20 is shaped in a rectangle (including a square) in plan view, and includes the band part 25 having a strip shape and extending outward in the radial direction from two facing sides. The movable contact 20 has a dome shape protruding toward the key body 11 substantially at a central part in plan view. The movable contact 20 includes a substantially circular first through-hole 22 penetrating in the up-down direction in a region including the central part in plan view. The first through-hole 22 has an area smaller than that of the pusher 16. This configuration allows the pusher 16 positioned below the key body 11 to contact with the periphery of the first through-hole 22 when the operation key 10 is pushed toward the substrate 40, thereby pushing down the vicinity of the first through-hole 22 of the movable contact 20 toward the substrate 40. The first through-hole 22 does not need to be formed such that the center of the first through-hole 22 coincides with the central part of the movable contact 20 as long as the first through-hole 22 includes a central part of the movable contact 20 in plan view. This applies to any other embodiment below.

The movable contact 20 includes an upper contact part 21 in a circular ring and dome shape on the periphery of the first through-hole 22, a stepped part 23 formed in a circular ring shape in plan view on the outer periphery of the upper contact part 21 and bending downward at a steep angle, and a skirt plate part 24 continuously provided outside of the stepped part 23 in the radial direction. The band part 25 extends outward in the radial direction from the skirt plate part 24 and corresponds to an outer fixing part disposed outside of the upper contact part 21 in the radial direction and fixed outside of the key body 11 of the operation key 10 in the radial direction. The band part 25 is provided to the movable contact 20 such that the band part 25 can be fixed to the corresponding intermediate part 13 of the operation key 10. With this configuration, the movable contact 20 and the operation key 10 are connected with each other only through the band part 25 of the movable contact 20. The upper contact part 21 is spaced apart from a site directly below the key body 11 (the position of the pusher 16) when the movable contact 20 is fixed below the operation key 10, and contacts with a contact (second contact) 42 when the key body 11 is pushed in. When the movable contact 20 is pushed and inverted, vibration of an end part of the movable contact 20 is absorbed by an elastic member in contact with this end part. Accordingly, operation noise of the movable contact 20 is reduced to achieve an excellent noise reduction effect. In embodiments described below, the same effect can be obtained although duplicate description thereof will be omitted. The stepped part 23 functions as the pivot of deflection deformation of the upper contact part 21.

The movable contact 20 preferably further includes an outer contact part 26 disposed outside of the upper contact part 21 in the radial direction of the movable contact 20 and opposite to another contact (first contact) 41 in a non-contact manner, which is disposed outside of the second contact 42 configured to contact with the upper contact part 21 in the radial direction, and the outer contact part 26 is configured to contact with the first contact 41 when the key body 11 is pushed in. The outer contact part 26 and the first contact 41 may have any gap therebetween that allows the outer contact part 26 and the first contact 41 to contact with each other when the operation key 10 is pushed in toward the substrate 40. In the present embodiment, the gap between the outer contact part 26 and the first contact 41 is 0.03 to 0.1 mm inclusive. The outer contact part 26 may be in contact with the first contact 41.

As illustrated in FIG. 2, the outer contact part 26 is a cup-shaped part formed as a downward recess on the skirt plate part 24 of the movable contact 20. A total of four of the outer contact parts 26 are formed at four corners of the skirt plate part 24. This configuration allows the movable contact 20 to contact with the first contact 41 at four places when the key body 11 is pushed in. However, the number of outer contact parts 26 is not particularly limited but may be any number larger than zero. To prevent the movable contact 20 from tilting when the movable contact 20 contacts with the first contact 41, one pair or a plurality of pairs of outer contact parts 26 are preferably provided at positions facing to each other across the center of the movable contact 20. Alternatively, no outer contact part 26 may be provided, and any other site such as the upper contact part 21 may be configured to contact with the first contact 41. Such a configuration will be described in another embodiment to be described later.

The movable contact 20 may be made of a conductive metallic material. Examples of the metallic material include stainless steel, aluminum, aluminum alloy, carbon steel, copper, copper alloy (bronze, phosphor bronze, brass, cupronickel, or nickel silver, for example), silver, and any alloy selectively made of two or more of the above-described metals. A particularly preferable metallic material is SUS301 but may be, for example, austenitic stainless steel other than SUS301, martensitic stainless steel, ferritic stainless steel, or austenitic-ferritic two-phase stainless steel. Alternatively, the movable contact 20 may be made of a resin base material. For example, the movable contact 20 may be manufactured by forming a carbon, silver, or copper film on one surface made of transparent resin such as polypropylene, methyl polymethacrylate, polystyrene, polyamide 6, polyamide 66, polyamide 610, polyethylene terephthalate, polyethylene naphthalate, or polycarbonate, and performing shaping thereof into an inverted cup shape. Whether the movable contact 20 is made of metal or resin, surface treatment such as plating or evaporation coating can be provided in a single layer or a plurality of layers on at least a surface of the movable contact 20, with which a fixed electrode contacts, to achieve corrosion resistance, dust tightness, or stable conduction. It is particularly preferable that the surface treatment involves gold plating (at a thickness of 0.05 μm approximately) and sealing treatment. The gold plating is desirably performed at a thickness as large as possible in terms of corrosion resistance in theory. However, in reality, the thickness is restricted in terms of cost, and is 0.01 μm to 1.00 μm inclusive, preferably 0.03 μm to 0.50 μm inclusive, more preferably 0.05 μm to 0.30 μm inclusive. Examples of surface treatment other than those described above include: gold plating; nickel plating, gold plating, and sealing treatment; nickel plating and gold plating; nickel plating; silver plating; nickel plating and silver plating; silver plating and sealing treatment (anti-sulfuration treatment (anti-discoloring treatment)); nickel plating, silver plating, and sealing treatment (anti-sulfuration treatment (anti-discoloring treatment)); and application of carbon conductive ink or carbon conductive paint. The surface treatment may use gold alloy, silver alloy, palladium, palladium alloy, tungsten, or tungsten alloy.

(3) Substrate

As illustrated in FIGS. 3A-3C, the LED 50 as the illumination means is preferably fixed to the substrate 40 at a position directly below the first through-hole 22 of the movable contact 20. The substrate 40 includes the second contact 42 at the outer periphery of the LED 50, and the first contact 41 at the outer periphery of the second contact 42. The first contact 41 is disposed at such a position that the outer contact part 26 being moved down when the key body 11 is pushed down can contact with the first contact 41. The second contact 42 is spaced apart from the first contact 41 at such a position that the upper contact part 21 being moved down when the key body 11 is pushed down can contact with the second contact 42. In the present embodiment, the first and second contacts 41 and 42 both have closed circular ring shapes. With this configuration, the switch is not turned on when the outer contact part 26 of the movable contact 20 contacts with the first contact 41. A circuit connecting the first and second contacts 41 and 42 through the movable contact 20 is formed when the upper contact part 21 of the movable contact 20 contacts with the second contact 42, thereby turning on the switch. The shapes of the first and second contacts 41 and 42 and the existence thereof may be modified in various manners. Typical modifications will be described later.

The first and second contacts 41 and 42 are partially buried below the substrate 40 while surfaces thereof are exposed on the substrate 40. However, the first and second contacts 41 and 42 may be formed on the surface of the substrate 40 but not buried below the substrate 40. The LED 50, which is fixed to the surface of the substrate 40, may be partially buried below the substrate 40. The recess 17 is formed in the key body 11 to avoid contact between the LED 50 and the pusher 16 when the key body 11 is pushed down. However, the recess 17 does not need to be formed when this contact does not occur because, for example, the LED 50 is buried in the substrate 40.

The first and second contacts 41 and 42 are favorably made of a relatively highly conductive metallic material such as gold, silver, copper, aluminum bronze, aluminum alloy, or alloy of two or more of these materials. Plating in a single layer or a plurality of layers may be provided on the surfaces of the first and second contacts 41 and 42 for corrosion resistance and stable conduction thereof. The plating may be performed with, for example, gold, silver, or nickel or with an alloy containing, as a primary component, one or more these materials. Examples of any illumination means other than the LED 50 include a filament-heating light bulb.

FIG. 5 illustrates plan views of the substrate illustrated in FIGS. 3A-3C and various modifications thereof.

The substrate 40 in (5A) of FIG. 5 is the substrate described with reference to FIGS. 3A-3C. Alternatively, as illustrated in (5B) of FIG. 5, the substrate 40 may be provided with two semicircular ring contacts 42*a* and 42*a* inside of two semicircular ring contacts 41*a* and 41*b* and the LED 50 may be disposed inside of the contacts 42*a* and 42*a*. With this configuration, a circuit connecting the first contacts 41*a* and 41*a* through the movable contact 20 is formed when the outer contact part 26 of the movable contact 20 contacts with the first contacts 41*a* and 41*a*, thereby turning on a first switch. Subsequently, a circuit connecting the second contacts 42*a* and 42*a* through the movable contact 20 is formed when the upper contact part 21 of the movable contact 20 contacts with the second contacts 42*a* and 42*a*, thereby turning on a second switch.

The LED 50 is not essential to the pushbutton switch member 30 according to the present embodiment. When the LED 50 is not provided, the substrate 40 illustrated in (5C) of FIG. 5, (5D) of FIG. 5, or (5E) of FIG. 5 can be used. In the substrate 40 in (5C) of FIG. 5, a circular second contact 42*b* is disposed inside of the circular ring-first contact 41. With this configuration, the switch is not turned on when the outer contact part 26 of the movable contact 20 contacts with the first contact 41. A circuit connecting the first contact 41 and the second contact 42*b* through the movable contact 20 is formed when the upper contact part 21 of the movable contact 20 contacts with the second contact 42*b*, thereby turning on the switch. In the substrate 40 in (5D) of FIG. 5, semicircular second contacts 42*c* and 42*c* are disposed inside of the two semicircular ring-first contacts 41*a* and 41*a*. With this configuration, a two-staged switch similar to that of the substrate 40 in (5B) of FIG. 5 can be achieved. In the substrate 40 in (5E) of FIG. 5, two semicircular comb-teeth shaped contacts 42*d* and 42*d* meshing with each other are separately disposed inside of the two semicircular ring-first contacts 41*a* and 41*a*. The semicircular comb-teeth shapes of the second contacts 42*d* and 42*d* provide more reliable conduction between the second contacts 42*d* and 42*d*. With this configuration, a two-staged switch similar to that of the substrate 40 in (5B) of FIG. 5 can be achieved.

The substrate 40 in (5F) of FIG. 5 may be employed only to allow the upper contact part 21 of the movable contact 20 to contact with a contact on the substrate 40. In this substrate 40, two semicircular comb-teeth shaped first contacts 41*b* and 41*b* meshing with each other are separately disposed. The outer contact parts 26 are disposed outside of the first contacts 41*b* and 41*b* in the radial direction, and do not function as conduction means. A circuit connecting the first contacts 41*b* and 41*b* through the movable contact 20 is formed when the upper contact part 21 of the movable contact 20 contacts with the first contacts 41*b* and 41*b*, thereby turning on the switch. The substrate 40 does not need to be included as a component of the pushbutton switch member 30.

Second Embodiment

The following describes a pushbutton switch member according to a second embodiment. In the second embodiment, any component identical to that in the first embodiment is denoted by an identical reference sign, and any duplicate description of configuration and operation thereof will be omitted but should be given by referring to the description in the first embodiment.

Figure 6A:
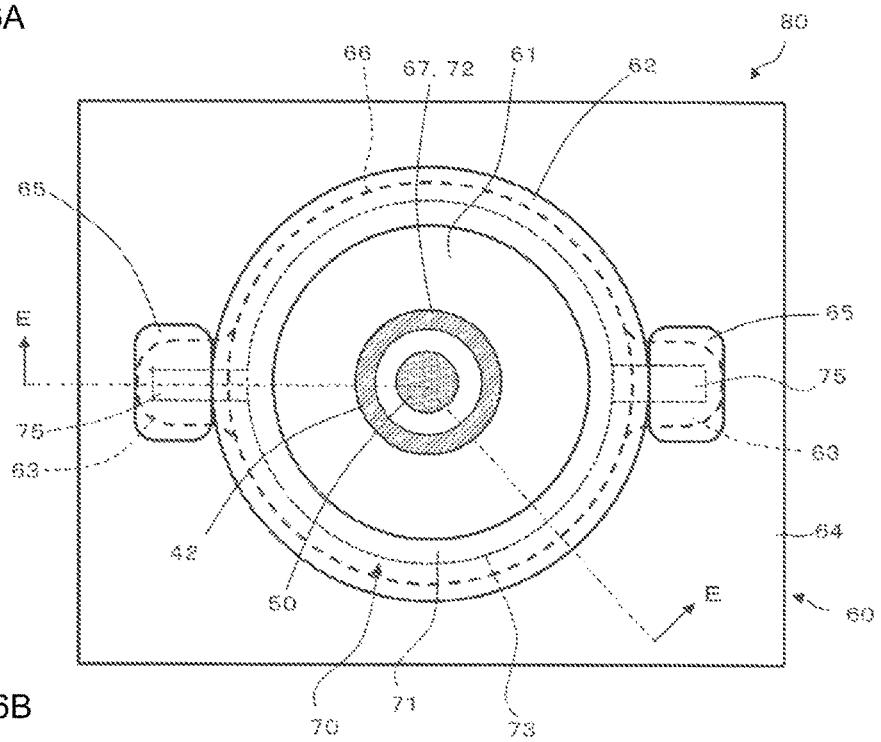
FIGS. 6A and 6B illustrate a transparent plan view (FIG. 6A) of a pushbutton switch member according to a second embodiment and a line E-E cross-sectional view (FIG. 6B) taken along line E-E (line bent at the center of the pushbutton switch member) in this transparent plan view.
Figure 6B:
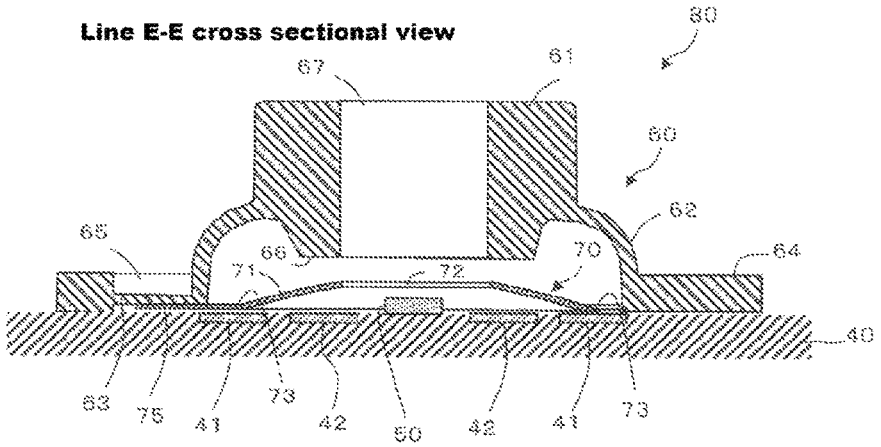
Figure 7:
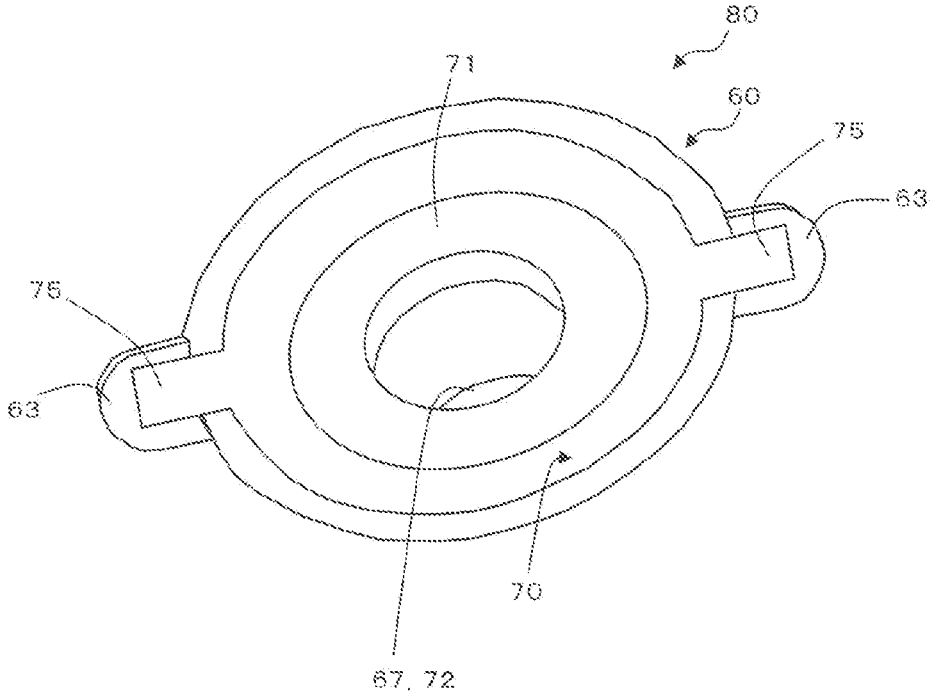
FIG. 7 illustrates a back-surface perspective view of the pushbutton switch member illustrated in FIG. 6 when obliquely viewed from back.

FIG. 6 illustrates a transparent plan view (6A) of the pushbutton switch member according to the second embodiment and a line E-E cross-sectional view (6B) taken along line E-E (line bent at the center of the pushbutton switch member) in this transparent plan view. FIG. 7 illustrates a back-surface perspective view of the pushbutton switch member illustrated in FIG. 6 when obliquely viewed from back.

The pushbutton switch member 80 according to the second embodiment includes a dome-shaped movable contact 70, and an operation key 60 disposed on a protrusion side of the movable contact 70, the operation key 60 being opposite to and spaced apart from the movable contact 70. Pushing the operation key 60 toward the movable contact 70 causes the movable contact 70 to electrically connect at least two contacts (the first and second contacts 41 and 42) on the substrate 40.

(1) Operation Key

The operation key 60 includes a key body 61, a dome part 62 connected with the outer periphery of the key body 61 and deformable by pushing of the key body 61 toward the substrate 40, and a foot part 64 connected with the outer periphery of the dome part 62 and fixed on the substrate 40. As illustrated in FIG. 6, the operation key 60 preferably includes, between the dome part 62 and the foot part 64, two intermediate parts 63 facing to the substrate 40 with a gap interposed therebetween. The two intermediate parts 63 are provided at positions facing to each other across a central part of the operation key 60 in plan view, and correspond to sites of connection with the movable contact 70. The operation key 60 includes a downward recess 65 above each intermediate part 63. Thus, the intermediate part 63 has a thickness smaller than the length (thickness) of the foot part 64 in the up-down direction. The recess 65 provides effects same as those of the recess 15 described in the first embodiment, and is not essential like the recess 15.

The key body 61 has a substantially cylindrical shape and is supported to be floating above the substrate 40 by the dome part 62. The key body 61 includes, substantially at a lower central part in plan view, a pusher 66 protruding in a substantially cylindrical shape toward the substrate 40. The operation key 60 includes, substantially at a central part of the key body 61, a second through-hole 67 penetrating in the up-down direction from outside of the key body 61 toward the movable contact 70. The second through-hole 67 is a site in which the LED 50 as an illumination means is housed when the key body 61 is moved downward. The second through-hole 67 has an area smaller than that of a lower surface of the pusher 66. The dome part 62 has a substantially cylindrical skirt shape penetrating from the key body 61 side to the substrate 40 side, and has a larger diameter toward the substrate 40 side. The dome part 62 is made of a thin elastic material designed such that the dome part 62 deforms halfway through the process of pushing down the key body 61 toward the substrate 40 and then returns to the original shape when the push is canceled. In the present embodiment, the entire operation key 60 including the dome part 62 is made of an elastic material, but only the dome part 62 may be made of an elastic material. The foot part 64 is a thin plate shaped in such a rectangle (including a square) in plan view that a part other than the intermediate parts 63 is allowed to contact with the substrate 40. The operation key 60 is made of a material same as that of the operation key 10 according to the first embodiment. The operation key 60, which is provided with the second through-hole 67, does not need to be translucent.

(2) Movable Contact

The movable contact 70 is circular in plan view and includes band parts 75 having strip shapes and extending outward in the radial direction at positions facing to each other in the diameter direction. The movable contact 70 has such a dome shape that a substantially central part thereof in plan view protrudes toward the key body 61. The movable contact 70 is provided with a substantially circular first through-hole 72 penetrating in the up-down direction in a region including a central part thereof in plan view. The first through-hole 72 has an area smaller than that of the pusher 66. This configuration allows the pusher 66 positioned below the key body 61 to contact with the periphery of the first through-hole 72 when the operation key 60 is pushed toward the substrate 40, thereby pushing down the vicinity of the first through-hole 72 of the movable contact 70 toward the substrate 40.

The movable contact 70 includes an upper contact part 71 in a circular ring and dome shape on the periphery of the first through-hole 72, and a bent part 73 having a circular shape in plan view on the outer periphery of the upper contact part 71. Each band part 75 extends from part of the bent part 73 outward in the radial direction and corresponds to an outer fixing part disposed outside of the upper contact part 71 in the radial direction and fixed outside of the key body 61 of the operation key 60 in the radial direction. The band part 75 is provided to the movable contact 70 such that the band part 75 can be fixed to the intermediate part 63 of the operation key 60. With this configuration, the movable contact 70 and the operation key 60 are connected with each other only through the band part 75 of the movable contact 70. The upper contact part 71 is spaced apart from a site directly below the key body 71 (the position of the pusher 66) when the movable contact 70 is fixed below the operation key 60, and contacts with the second contact 42 when the key body 61 is pushed in. The bent part 73 functions as the pivot of deflection deformation of the upper contact part 71.

The movable contact 70 does not include the outer contact part 26 unlike the pushbutton switch member 30 according to the first embodiment. An outer part of the upper contact part 71 in plan view is configured to contact with the first contact 41. The outer part of the upper contact part 71 and the first contact 41 may have any gap therebetween that allows the upper contact part 71 and the first contact 41 to contact with each other when the operation key 60 is pushed in toward the substrate 40. In the present embodiment, the gap between the outer part of the upper contact part 71 and the first contact 41 is 0.03 to 0.1 mm inclusive. The upper contact part 71 may be in contact with the first contact 41. The movable contact 70 is made of a material same as that of the movable contact 20 according to the first embodiment.

(3) Substrate

The substrate 40 has a structure same as that of the substrate described in the first embodiment, but may have other structures illustrated in (5B) to (5F) of FIG. 5. The substrate 40 may be included or not included in the pushbutton switch member 80.

(4) Modifications of Pushbutton Switch Member

Figure 8A:
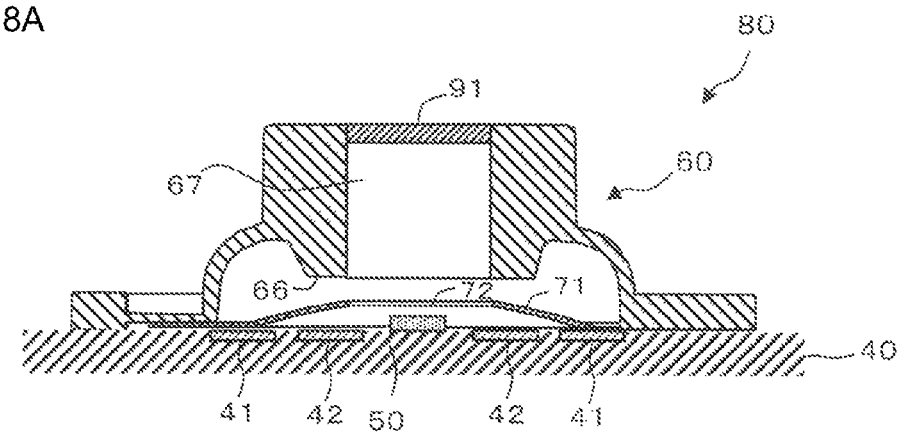
FIGS. 8A-8C illustrate cross-sectional views of various modifications of the pushbutton switch member illustrated in FIG. 6 (mainly, an operation key).
Figure 8B:
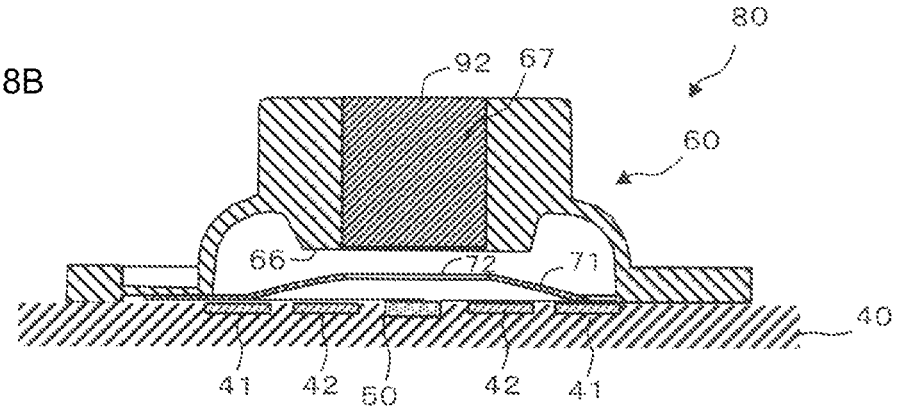
Figure 8C:
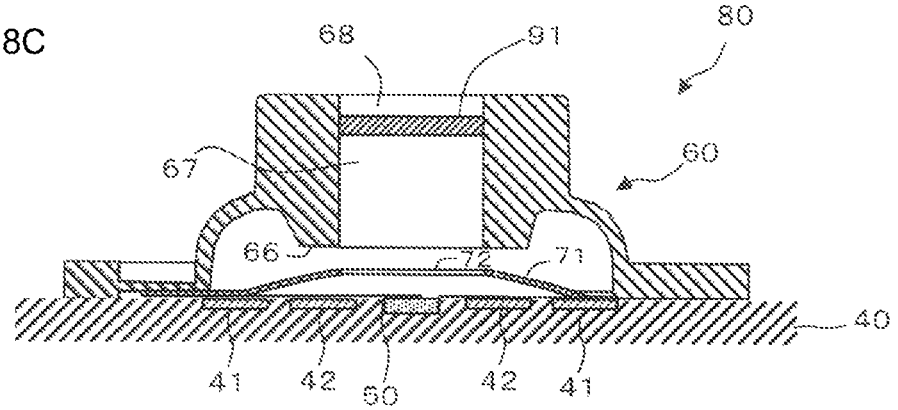
Figure 9A:
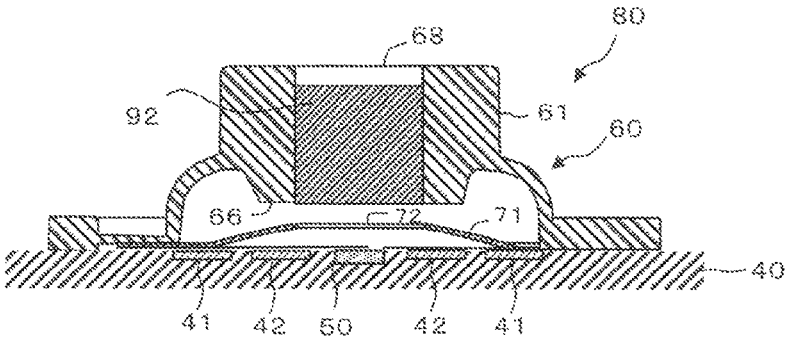
FIGS. 9A-9D illustrate cross-sectional views of the various modifications of the pushbutton switch member illustrated in FIG. 6 (mainly, the operation key), following FIG. 8.
Figure 9B:
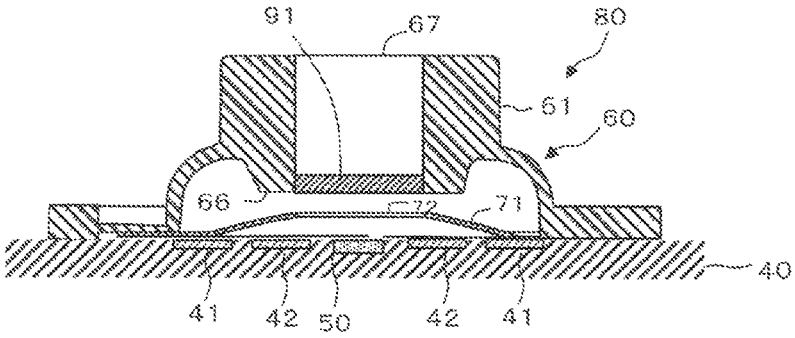
Figure 9C:
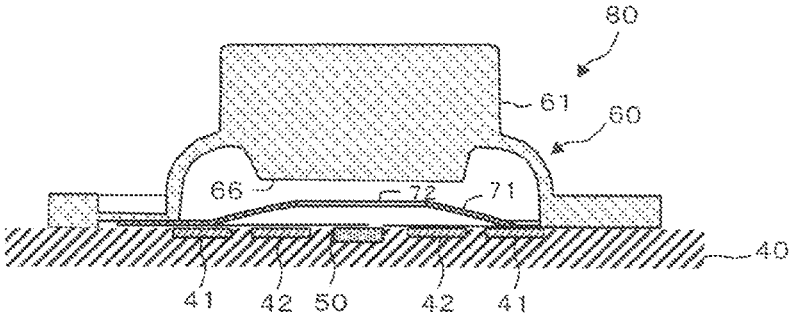
Figure 9D:
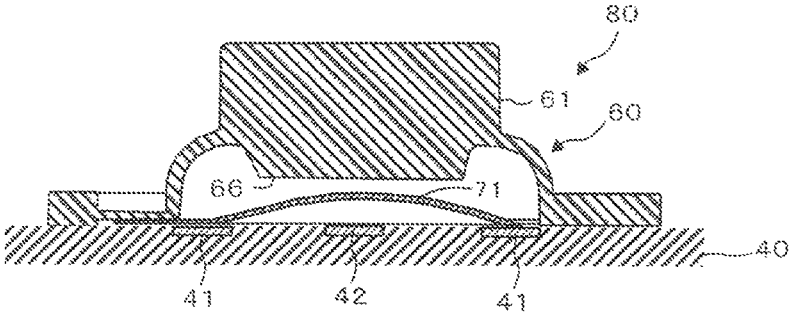
Figure 10A:
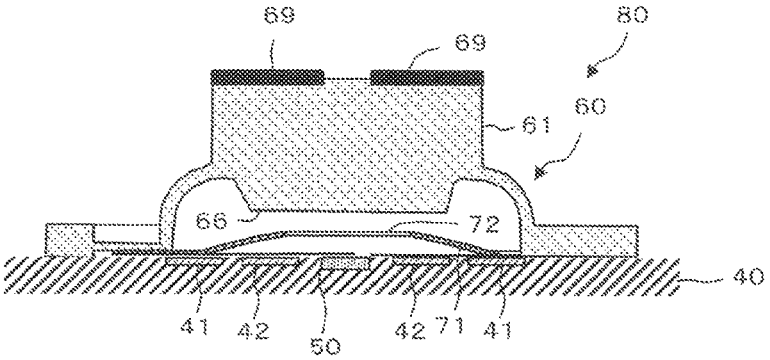
FIGS. 10A-10C illustrate cross-sectional views of the various modifications of the pushbutton switch member illustrated in FIG. 6 (mainly, the operation key), following FIG. 9.
Figure 10B:
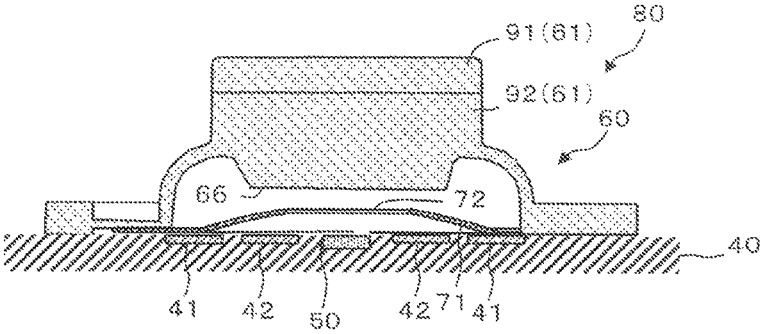
Figure 10C:
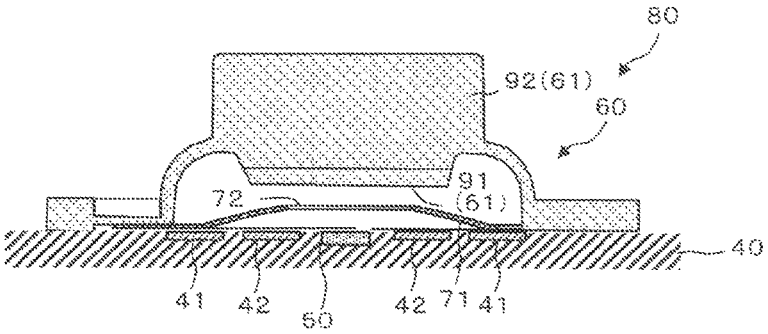

FIGS. 8, 9, and 10 illustrate cross-sectional views of various modifications of the pushbutton switch member illustrated in FIG. 6 (mainly, the operation key).

The pushbutton switch member 80 illustrated in (8A) of FIG. 8 includes a lid unit 91 made of a translucent material on an upper surface side of the key body 61 in the second through-hole 67. With this configuration, light from the LED 50 can be externally transmitted through the lid unit 91. Examples of the material of the lid unit 91 include translucent elastomer such as silicone rubber, translucent resin such as acrylic resin, glass, and translucent ceramics.

In the pushbutton switch member 80 illustrated in (8B) of FIG. 8, the second through-hole 67 is filled with a filling part 92 made of a translucent material. The LED 50 is buried inside the substrate 40 and does not protrude out of the substrate 40. This configuration is intended to prevent contact between the filling part 92 and the LED 50. With this configuration, light from the LED 50 can be externally transmitted through the filling part 92. The filling part 92 may be made of a material same as that of the lid unit 91.

In the pushbutton switch member 80 illustrated in (8C) of FIG. 8, the lid unit 91 made of a translucent material is provided halfway through the second through-hole 67 in the length direction thereof. A recess 68 is provided above the lid unit 91. The LED 50 is buried inside the substrate 40 and does not protrude out of the substrate 40, but may be disposed protruding out of the substrate 40 when a sufficient recess space is provided below the lid unit 91. With this configuration, light from the LED 50 can be externally transmitted through the lid unit 91, and pushing of the key body 61 can be easily checked with a finger.

In the pushbutton switch member 80 illustrated in (9A) of FIG. 9, the filling part 92 made of a translucent material is provided in a lower region of the second through-hole 67 in the length direction thereof. The recess 68 is provided above the filling part 92. The LED 50 is buried inside the substrate 40 and does not protrude out of the substrate 40. This configuration can achieve any effect same as that of the pushbutton switch member 80 in (8C) of FIG. 8.

In the pushbutton switch member 80 illustrated in (9B) of FIG. 9, the lid unit 91 made of a translucent material is provided on a lower surface side of the pusher 66 in the second through-hole 67. The LED 50 is buried inside the substrate 40 and does not protrude out of the substrate 40. This configuration can achieve any effect same as that of the pushbutton switch member 80 in (8C) of FIG. 8.

When the operation key 60 is not translucent but a translucent material (such as the lid unit 91 or the filling part 92) is buried partially or entirely in the second through-hole 67 in the length direction thereof in this manner, light from the LED 50 can be externally transmitted, and external dust and dirt are unlikely to enter inside the operation key 60.

When the operation key 60 is made of a highly translucent material as illustrated in (9C) of FIG. 9, light from the LED 50 can be transmitted out of the key body 61 without the second through-hole 67 formed in the key body 61.

When the LED 50 is not provided to the substrate 40 as illustrated in (9D) of FIG. 9, the operation key 60 may be made of a non-translucent material and the movable contact 70 does not need to be provided with the first through-hole 72.

When the operation key 60 is made of a highly translucent material and a light-shielding layer 69 is partially provided at least on a top surface (upper surface) of the key body 61 as illustrated in (10A) of FIG. 10, light from the LED 50 can be transmitted through a part not covered by the light-shielding layer 69. The light-shielding layer 69 may be provided to, for example, a side surface of the key body 61 or the dome part 62.

As illustrated in (10B) or (10C) of FIG. 10, the key body 61 may have such a multi-layer structure that the top surface (upper surface) side and the movable contact 70 side thereof are made of materials having different hardness values. In the pushbutton switch member 80 illustrated in (10B) of FIG. 10, the upper surface side of the key body 61 is a resin layer 91, and the movable contact 70 side thereof is a rubber layer 92 having hardness lower than that of the resin layer 91.

In the pushbutton switch member 80 illustrated in (10C) of FIG. 10, the upper surface side of the key body 61 is the rubber layer 92, and the movable contact 70 side thereof is the resin layer 91 having hardness higher than that of the rubber layer 92. The resin layer 91 and the rubber layer 92 are preferably highly translucent. However, when the second through-hole 67 is provided, at least one of the resin layer 91 and the rubber layer 92 does not need to be translucent.

Third Embodiment

The following describes a pushbutton switch member according to a third embodiment. In the third embodiment, any component identical to that in the above-described embodiments is denoted by an identical reference sign, and any duplicate description of configuration and operation thereof will be omitted but should be given by referring to the description in the embodiments.

Figure 11A:
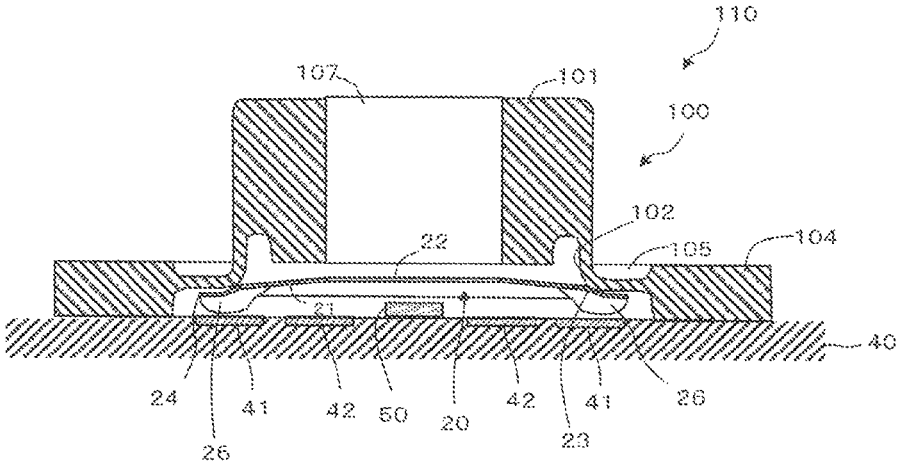
FIGS. 11A and 11B illustrate cross-sectional views of a pushbutton switch member according to a third embodiment (FIG. 11A) and a modification thereof (FIG. 11B), similarly to the line C-C cross-sectional view illustrated in FIG. 3E.
Figure 11B:
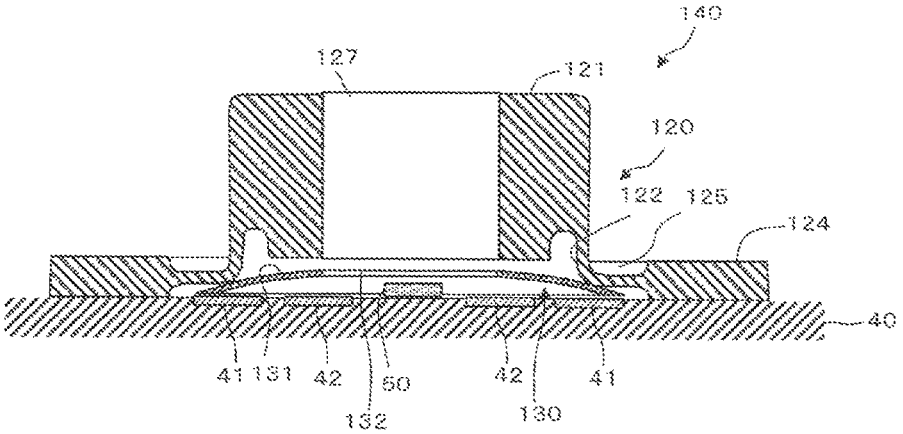

FIG. 11 illustrates cross-sectional views of a pushbutton switch member (11A) according to the third embodiment and a modification thereof (11B), similarly to the line C-C cross-sectional view illustrated in FIG. 3B.

The pushbutton switch member 110 in (11A) of FIG. 11 includes an operation key 100, and the dome-shaped movable contact 20 fixed below the operation key 100. The movable contact 20 does not include the band part 25, unlike the movable contact 20 according to the first embodiment. Any other structure is same as that of the first embodiment. The operation key 100 includes a key body 101, a dome part 102 connected with the outer periphery of the key body 101 and deformable by pushing of the key body 101 toward the substrate 40, and a foot part 104 connected with the outer periphery of the dome part 102 and fixed on the substrate 40. A ring groove 105 is provided above the dome part 102 to achieve reduction of the thickness of the dome part 102. The key body 101 is provided with, at a central part in plan view, a second through-hole 107 penetrating in the up-down direction from an upper surface thereof toward the movable contact 20.

The stepped part 23 or/and the skirt plate part 24 outside of the upper contact part 21 of the movable contact 20 in the radial direction are partially adhered to a lower part of the dome part 102. Thus, the stepped part 23 or/and the skirt plate part 24 each correspond to an outer fixing part disposed outside of the upper contact part 21 in the radial direction and fixed outside of the key body 101 of the operation key 100 in the radial direction. The dome part 102 and the movable contact 20 may be adhered to each other at a ring place along the circumference of the dome part 102 or only at a plurality of places along the circumference of the dome part 102.

A pushbutton switch member 140 in (11B) of FIG. 11 includes an operation key 120, and a dome-shaped movable contact 130 fixed below the operation key 120. The movable contact 130 has a structure same as that of the movable contact 70 according to the second embodiment, but does not include the band parts 75 unlike the movable contact 70. The movable contact 130 has an inverted dish shape, which is the shape of a dish being placed upside down, and is provided with a first through-hole 132 at the center thereof. A ring upper contact part 131 is provided outside of the first through-hole 132 in the radial direction. An outer part of the upper contact part 131 in plan view is configured to contact with the first contact 41. The outer part of the upper contact part 131 and the first contact 41 may have any gap therebetween that allows the upper contact part 131 and the first contact 41 to contact with each other when the operation key 120 is pushed in toward the substrate 40. In the present embodiment, the gap between the outer part of the upper contact part 131 and the first contact 41 is 0.03 to 0.1 mm inclusive. The upper contact part 131 may be in contact with the first contact 41. A peripheral part of the first through-hole 132 in the upper contact part 131 is configured to contact with the second contact 42 when a key body 121 is pushed down toward the movable contact 130. The movable contact 130 is made of a material same as that of the movable contact 20 according to the first embodiment.

Similarly to the operation key 100, the operation key 120 includes the key body 121, a dome part 122 connected with the outer periphery of the key body 121 and deformable by pushing of the key body 121 toward the substrate 40, and a foot part 124 connected with the outer periphery of the dome part 122 and fixed on the substrate 40. A ring groove 125 is provided above the dome part 122 to achieve reduction of the thickness of the dome part 122. The key body 121 is provided with, at a central part in plan view, a second through-hole 127 penetrating in the up-down direction from an upper surface thereof toward the movable contact 130.

An outer part of the upper contact part 131 of the movable contact 130 in the radial direction is at least partially adhered to a lower part of the dome part 122, and corresponds to an outer fixing part disposed at the upper contact part 131 and fixed outside of the key body 121 of the operation key 120 in the radial direction. The dome part 122 and the movable contact 130 may be adhered to each other at a ring place along the circumference of the dome part 122 or only at a plurality of places along the circumference of the dome part 122.

When the movable contact 20 (130) is fixed to the dome part 102 (122) of the operation key 100 (120) in this manner, impact of contact of the upper contact part 21 (131) of the dome part 102 (122) with the first contact 41 can be reduced by the dome part 102 (122), which leads to further reduction of noise of the contact. This is because the dome part 102 (122) including a rubber elastic body functions as an impact buffer.

Fourth Embodiment

The following describes a pushbutton switch member according to a fourth embodiment. In the fourth embodiment, any component identical to that in the above-described embodiments is denoted by an identical reference sign, and any duplicate description of configuration and operation thereof will be omitted but should be given by referring to the description in the embodiments.

Figure 12A:
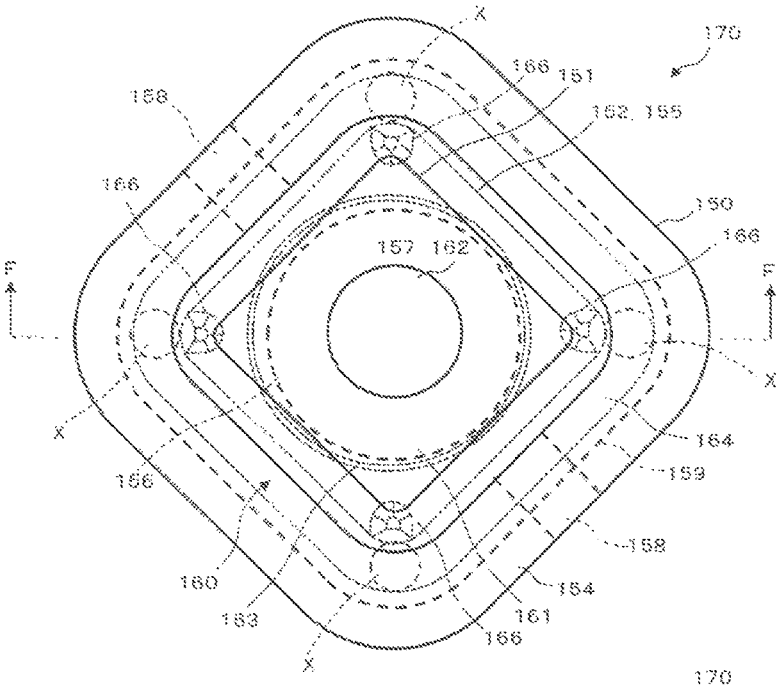
FIGS. 12A and 12B illustrate a transparent plan view (FIG. 12A) of a pushbutton switch member according to a fourth embodiment and a line F-F cross-sectional view thereof taken along line F-F in this transparent plan view (FIG. 12B).
Figure 12B:
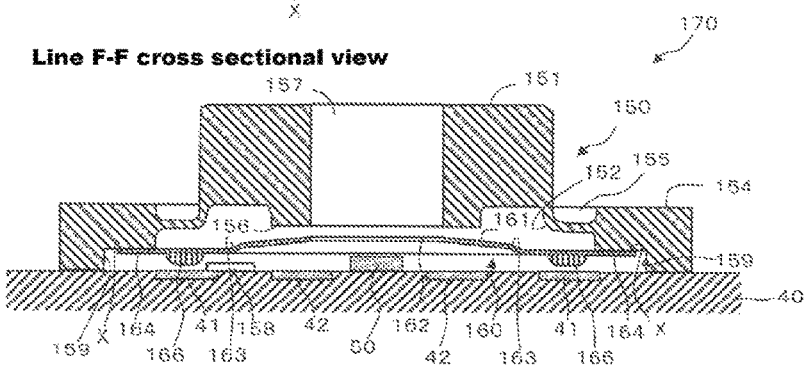

FIG. 12 illustrates a transparent plan view (12A) of the pushbutton switch member according to the fourth embodiment and a line F-F cross-sectional view taken along line F-F in this transparent plan view (12B).

The pushbutton switch member 170 according to the fourth embodiment includes a dome-shaped movable contact 160, and an operation key 150 disposed on a protrusion side of the movable contact 160, the operation key 150 being opposite to and spaced apart from the movable contact 160. Pushing the operation key 150 toward the movable contact 160 causes the movable contact 160 to electrically connect at least two contacts (the first and second contacts 41 and 42) on the substrate 40.

(1) Operation Key

The operation key 150 includes a key body 151, a dome part 152 connected with the outer periphery of the key body 151 and deformable by pushing of the key body 151 toward the substrate 40, and a foot part 154 connected with the outer periphery of the dome part 152 and fixed on the substrate 40. A rectangular ring groove 155 is provided above the dome part 152 to achieve reduction of the thickness of the dome part 152. The key body 151 is provided with, at a central part in plan view, a second through-hole 157 penetrating in the up-down direction from an upper surface thereof toward the movable contact 160. The key body 151 has a substantially rectangular parallelepiped shape and is supported to be floating above the substrate 40 by the dome part 152. The key body 151 includes, substantially at a lower central part in plan view, a pusher 156 protruding in a substantially cylindrical shape toward the substrate 40. An inner part of the foot part 154 in the radial direction is preferably a recessed region 159 in non-contact with the substrate 40. The foot part 154 includes one or more airflow paths 158 on the circumference thereof. In the present embodiment, the operation key 150 includes two airflow paths 158 at positions facing to each other across the center thereof. This achieves air communication between a space enclosed by the operation key 150 and the outside thereof in response to upward and downward movement of the operation key 150 when the second through-hole 157 is closed by a translucent material, thereby achieving more highly accurate pushing.

The second through-hole 157 is a site in which the LED 50 is housed when the key body 151 is moved downward. The second through-hole 157 has an area smaller than that of a lower surface of the pusher 156. The dome part 152 has a substantially rectangular tubular skirt shape penetrating from the key body 151 side to the substrate 40 side, and has a larger diameter toward the substrate 40. The dome part 152 is made of a thin elastic material designed such that the dome part 152 deforms halfway through the process of pushing down the key body 151 toward the substrate 40 and then returns to the original shape when the push is canceled. The foot part 154 is a plate shaped in a rectangle (including a square) in plan view. The operation key 150 is made of a material same as that of the operation key 10 according to the first embodiment. The operation key 150, which is provided with the second through-hole 157, does not need to be translucent.

(2) Movable Contact

The movable contact 160 is shaped in a rectangle (including a square) in plan view. The movable contact 160 has such a dome shape that a substantially central part thereof in plan view protrudes toward the key body 151. The movable contact 160 is provided with a substantially circular first through-hole 162 penetrating in the up-down direction in a region including a central part thereof in plan view. The first through-hole 162 has an area smaller than that of the pusher 156. This configuration allows the pusher 156 positioned below the key body 151 to contact with the periphery of the first through-hole 162 when the operation key 150 is pushed toward the substrate 40, thereby pushing down the vicinity of the first through-hole 162 of the movable contact 160 toward the substrate 40.

The movable contact 160 includes an upper contact part 161 in a circular ring and dome shape on the periphery of the first through-hole 162, a stepped part 163 formed in a circular ring shape in plan view on the outer periphery of the upper contact part 161 and bending downward at a steep angle, and a skirt plate part 164 continuously provided outside of the stepped part 163 in the radial direction. The skirt plate part 164 has a width larger than that of the skirt plate part 24 according to the first embodiment, and extends to the recessed region 159 provided inside of the foot part 154. The skirt plate part 164 is formed in a rectangular ring shape outside of the stepped part 163 in the radial direction, and adhered to the recessed region 159 of the operation key 150 at corners thereof (see adhesion sites X in 12A and 12B). The adhesion sites X are not limited to four places, but may be provided at two places. In the present embodiment, the skirt plate part 164 corresponds to an outer fixing part fixed outside of the key body 151 of the operation key 150 in the radial direction. The movable contact 160 and the operation key 150 are connected with each other only through the adhesion sites X of the skirt plate part 164. The upper contact part 161 is spaced apart from a site directly below the key body 151 (the position of the pusher 156) when the movable contact 160 is fixed below the operation key 150, and contacts with the second contact 42 when the key body 151 is pushed in. The stepped part 163 functions as the pivot of deflection deformation of the upper contact part 161.

The movable contact 160 preferably further includes an outer contact part 166 disposed outside of the stepped part 163 in the radial direction of the movable contact 160 and opposite to the first contact 41 in a non-contact manner and configured to contact with the first contact 41 when the key body 151 is pushed in. The outer contact part 166 and the first contact 41 may have any gap therebetween that allows the outer contact part 166 and the first contact 41 to contact with each other when the operation key 150 is pushed in toward the substrate 40. In the present embodiment, the gap between the outer contact part 166 and the first contact 41 is 0.03 to 0.1 mm inclusive. The outer contact part 166 may be in contact with the first contact 41.

Similarly to the outer contact part 26 according to the first embodiment, the outer contact part 166 is a cup-shaped part formed as a downward recess on the skirt plate part 164 of the movable contact 160. A total of four of the outer contact parts 166 are formed at four corners of the skirt plate part 164. This configuration allows the movable contact 160 to contact with the first contact 41 at four places when the key body 151 is pushed in. However, similarly to the outer contact parts 26 described above, the number of outer contact parts 166 is not particularly limited but may be any number larger than zero. One pair or a plurality of pairs of the outer contact parts 166 are preferably provided at positions facing to each other across the center of the movable contact 160. The movable contact 160 is made of a material same as that of the movable contact 20 according to the first embodiment.

Fifth Embodiment

The following describes a pushbutton switch member according to a fifth embodiment. In the fifth embodiment, any component identical to that in the above-described embodiments is denoted by an identical reference sign, and any duplicate description of configuration and operation thereof will be omitted but should be given by referring to the description in the embodiments.

Figure 13A:
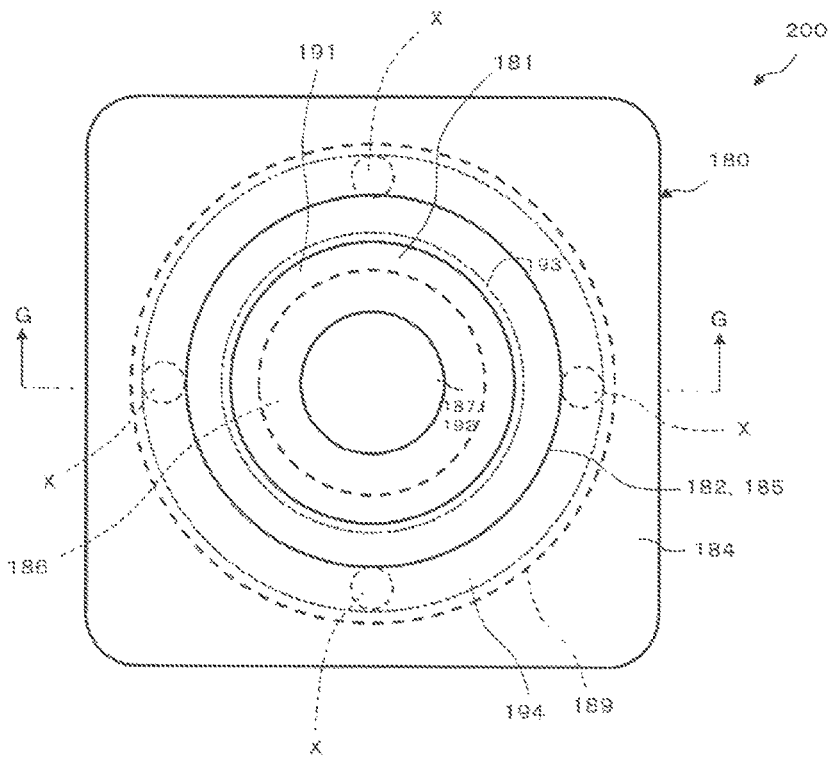
FIGS. 13A and 13B illustrate a transparent plan view (FIG. 13A) of a pushbutton switch member according to a fifth embodiment and a line G-G cross-sectional view thereof taken along line G-G in this transparent plan view (FIG. 13B).
Figure 13B:
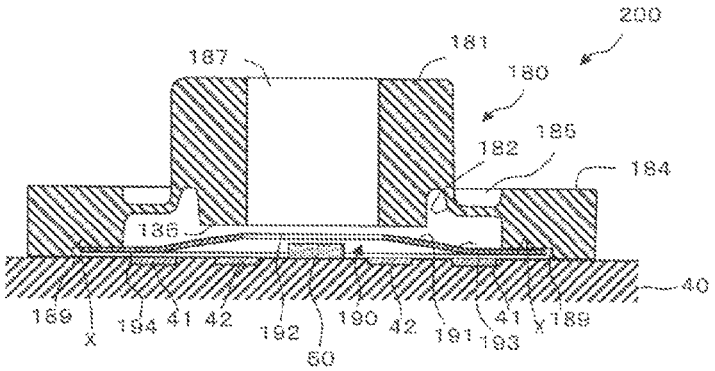

FIG. 13 illustrates a transparent plan view (13A) of the pushbutton switch member according to the fifth embodiment and a line G-G cross-sectional view taken along line G-G in this transparent plan view (13B).

The pushbutton switch member 200 according to the fifth embodiment includes a dome-shaped movable contact 190, and an operation key 180 disposed on a protrusion side of the movable contact 190, the operation key 180 being opposite to and spaced apart from the movable contact 190. Pushing the operation key 180 toward the movable contact 190 causes the movable contact 190 to electrically connect at least two contacts (the first and second contacts 41 and 42) on the substrate 40.

(1) Operation Key

The operation key 180 includes a key body 181, a dome part 182 connected with the outer periphery of the key body 181 and deformable by pushing of the key body 181 toward the substrate 40, and a foot part 184 connected with the outer periphery of the dome part 182 and fixed on the substrate 40. A circular ring groove 185 is provided above the dome part 182 to achieve reduction of the thickness of the dome part 182. The key body 181 is provided with, at a central part in plan view, a second through-hole 187 penetrating in the up-down direction from an upper surface thereof toward the movable contact 190. The key body 181 has a substantially cylindrical shape and is supported to be floating above the substrate 40 by the dome part 182. The key body 181 includes, substantially at a lower central part in plan view, a pusher 186 protruding in a substantially cylindrical shape toward the substrate 40. An inner part of the foot part 184 in the radial direction is preferably a recessed region 189 in non-contact with the substrate 40.

The second through-hole 187 is a site in which the LED 50 is housed when the key body 181 is moved downward. The second through-hole 187 has an area smaller than that of a lower surface of the pusher 186. The dome part 182 has a substantially cylindrical skirt shape penetrating from the key body 181 side to the substrate 40 side, and has a larger diameter toward the substrate 40. The dome part 182 is made of a thin elastic material designed such that the dome part 182 deforms halfway through the process of pushing down the key body 181 toward the substrate 40 and then returns to the original shape when the push is canceled. The foot part 184 is a plate shaped in a rectangle (including a square) in plan view. The operation key 180 is made of a material same as that of the operation key 10 according to the first embodiment. The operation key 180, which is provided with the second through-hole 187, does not need to be translucent.

(2) Movable Contact

The movable contact 190 is circular in plan view, and has such a dome shape that a center part thereof protrudes toward the key body 181. The movable contact 190 is provided with a substantially circular first through-hole 192 penetrating in the up-down direction in a region including a central part thereof in plan view. The first through-hole 192 has an area smaller than that of the pusher 186. This configuration allows the pusher 186 positioned below the key body 181 to contact with the periphery of the first through-hole 192 when the operation key 180 is pushed toward the substrate 40, thereby pushing down the vicinity of the first through-hole 192 of the movable contact 190 toward the substrate 40.

The movable contact 190 includes an upper contact part 191 in a circular ring and dome shape on the periphery of the first through-hole 192, a bent part 193 having a circular ring shape in plan view on the outer periphery of the upper contact part 191, and a skirt plate part 194 extending from the bent part 193 outward in the radial direction. The skirt plate part 194 is provided by forming an external fixing part 75 according to the second embodiment in a circular ring shape outside of the bent part 193 in the radial direction, and extends to the recessed region 189 provided inside of the foot part 184. The skirt plate part 194 is adhered to the recessed region 189 of the operation key 180 at four adhesion sites X (see adhesion sites X in 13A and 13B) spaced at equal intervals on the circumference thereof. The adhesion sites X are not limited to four places but may be provided at two places. In the present embodiment, the skirt plate part 194 corresponds to an outer fixing part fixed outside of the key body 181 of the operation key 180 in the radial direction. The movable contact 190 and the operation key 180 are connected with each other only through the adhesion sites X of the skirt plate part 194. The upper contact part 191 is spaced apart from a site directly below the key body 181 (the position of the pusher 186) when the movable contact 190 is fixed below the operation key 180, and contacts with the second contact 42 when the key body 181 is pushed in. The bent part 193 functions as the pivot of deflection deformation of the upper contact part 191.

The movable contact 190 does not include the outer contact part 26 unlike the pushbutton switch member 30 according to the first embodiment. An outer part of the upper contact part 191 in plan view or/and the skirt plate part 194 are configured to contact with the first contact 41. The skirt plate part 194 and the first contact 41 may have any gap therebetween that allows the upper contact part 191 and the first contact 41 to contact with each other when the operation key 180 is pushed in toward the substrate 40. In the present embodiment, the gap between the skirt plate part 194 and the first contact 41 is 0.03 to 0.1 mm inclusive. The skirt plate part 194 may be in contact with the first contact 41. The movable contact 190 is made of a material same as that of the movable contact 20 according to the first embodiment.

Exemplary Load-Displacement Curve

Figure 14:
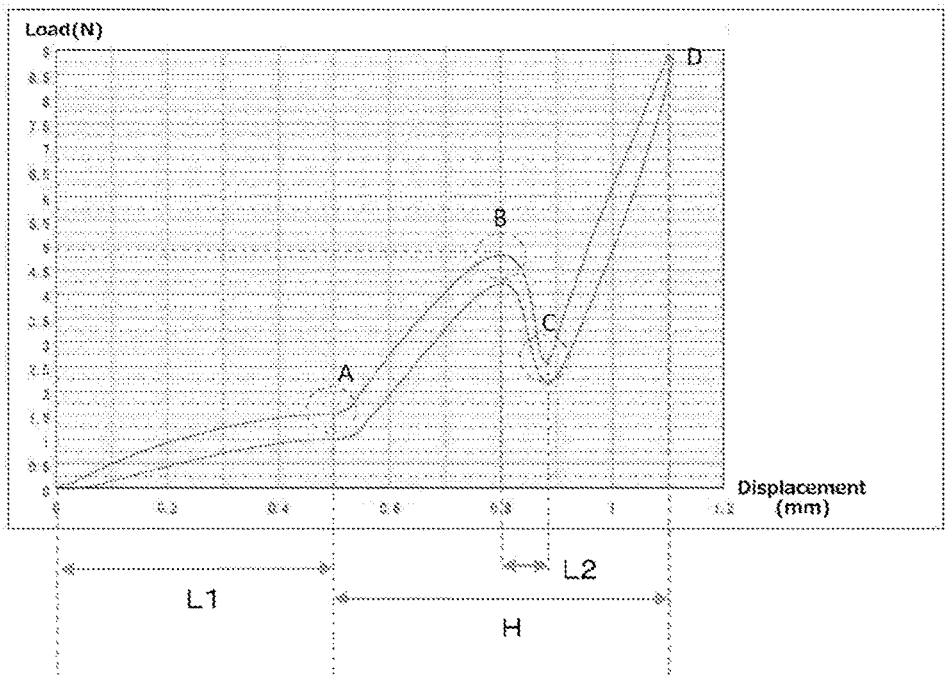
FIG. 14 illustrates a load-displacement curve of the pushbutton switch member according to the first embodiment.

FIG. 14 illustrates a load-displacement curve of the pushbutton switch member according to the first embodiment.

The curve illustrated in FIG. 14 represents a round-trip displacement when a load is applied on the key body 11 of the operation key 10 to push in the key body 11 until the movable contact 20 contacts with the second contact 42 and then the push on the key body 11 is canceled. At point A, the pusher 16 contacts with the upper contact part 21 of the movable contact 20. At point B (peak load point), the movable contact 20 starts deforming. At point C, the upper contact part 21 of the movable contact 20 contacts with the second contact 42. At point D, the push on the key body 11 is canceled.

A stroke (L1) from the start of the load application to point A is 0.5 mm approximately. This stroke is sufficiently so long that cannot be achieved by the movable contact 20 alone. The load curve (H) from point A to point D has a large gradient, similarly to the movable contact 20 alone. A stroke (L2) from point B to point C is 0.1 mm approximately. This stroke is long enough to provide a feeling of an ergonomically natural switch operation. At point I, the load is 5 N approximately. This peak load is larger than the peak load (3.5 N approximately) of the movable contact 20 alone and includes a load needed for deformation of the operation key 10, which indicates that the pushbutton switch member 30 is capable of sufficiently handling a high load.

Exemplary Usage of Pushbutton Switch Member

Figure 15A:
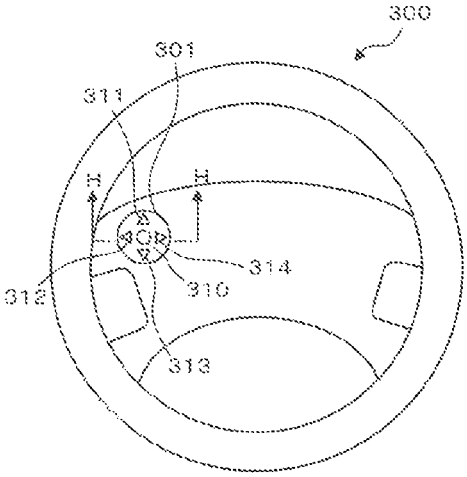
FIGS. 15A-15C include diagrams for description of exemplary usage of a multi-operation key on which a plurality of the pushbutton switch members illustrated in FIGS. 3A-3C are mounted, illustrating a front view (FIG. 15A) of the handle of an automobile in which the multi-operation key is incorporated, a front view (FIG. 15B) of the multi-operation key from which a front cover is removed, and a cross-sectional view (FIG. 15C) of the multi-operation key taken along line H-H in FIG. 15A.
Figure 15B:
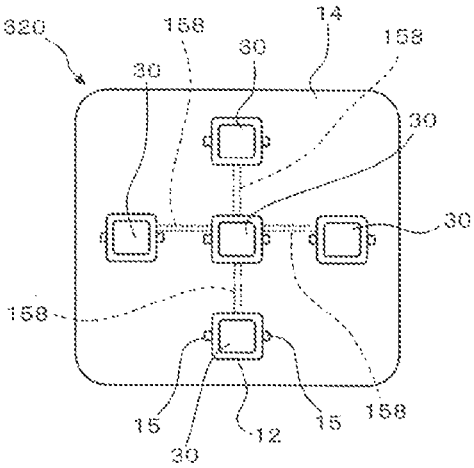
Figure 15C:
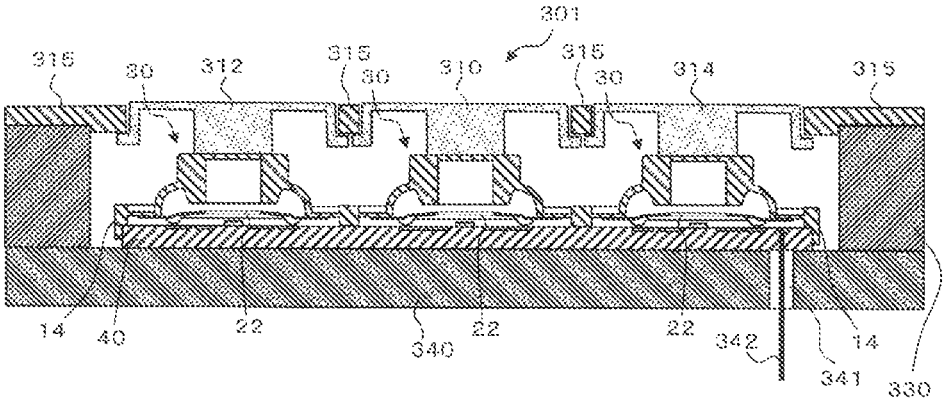

FIG. 15 includes diagrams for description of exemplary usage of a multi-operation key on which a plurality of the pushbutton switch members illustrated in FIGS. 3A-3C are mounted, illustrating a front view (15A) of the handle of an automobile in which the multi-operation key is incorporated, a front view (15B) of the multi-operation key from which a front cover is removed, and a line H-H cross-sectional view (15C) of the multi-operation key taken along line H-H in FIG. 15A.

As illustrated in (15A) of FIG. 15, a multi-operation key 301 on which a plurality (in this example, five) of the pushbutton switch members 30 are mounted is incorporated in a handle 300 of an automobile. The multi-operation key 301 includes a central key 310 and peripheral keys 311, 312, 313, and 314 at four positions spaced at substantially equal angles around the central key 310. The multi-operation key 301 includes a switch part 320 that is externally exposed as illustrated in (15B) of FIG. 15 when a front cover of the multi-operation key 301 is removed. The switch part 320 includes the pushbutton switch member 30 corresponding to each of the keys 310, 311, 312, 313, and 314. The foot part 14 is common to the keys 310, 311, 312, 313, and 314. The pushbutton switch member 30 includes the airflow paths 158 described in the fourth embodiment to reduce air resistance when operated.

Top plates 310, 312, and 313 as parts of the front cover are provided above the respective pushbutton switch members 30. The top plates 310, 312, and 313 are configured to independently move upward and downward. A housing 315 encloses the outer periphery of an upper part of the top plate 310 or the like. A sidewall 330 encloses the outer periphery of the assembly of the pushbutton switch members 30. Each pushbutton switch member 30 is disposed on the substrate 40. The substrate 40 is fixed on a back plate 340 and has an upper outer part covered by the foot part 14 of the pushbutton switch member 30. The back plate 340 is provided with a through-hole 341 reaching the substrate 40. Each contact (such as the first contact 41 or the second contact 42) and the LED 50 on the substrate 40 are electrically connected with a plurality of electric wires 342 through the through-hole 341.

In this manner, the pushbutton switch member 30 and the pushbutton switch members 80, 110, 140, 170, and 200 according to the other embodiments are each incorporated in the handle 300 of the automobile and serves as a switch that achieves various kinds of operations while avoiding interference with driving of the automobile and provides a long stroke and a strong click feeling. In addition, the pushbutton switch members 30, 80, 110, 140, 170, and 200 achieve excellent noise reduction effect.

Although the preferred embodiments of a pushbutton switch member according to the present invention are described above, the present invention is not limited to the above-described embodiments but may be modified in various manners.

For example, the operation keys 10, 60, 100, 120, 150, and 180 may be fixed to outer fixing parts such as the band parts 25 in the first embodiment, the band parts 75 in the second embodiment, the stepped part 23, the skirt plate part 24, and a site outside of the upper contact part 131 in the radial direction in the third embodiment, the skirt plate part 164 in the fourth embodiment, the skirt plate part 194 in the fifth embodiment by any method such as fixation with adhesive agent, fixation with a double-sided adhesive tape, fixation by engagement, or fixation by insertion of the outer fixing parts into grooves formed in the operation key 10 or the like.

The movable contact 20, 70, 130, 160, or 190 may be fixed to the operation key 10, 60, 100, 120, 150, or 180 at any site outside a position in the radial direction of the movable contact 20 or the like where the movable contact contacts with an innermost contact (for example, the second contact 42) at the top of the dome of the movable contact 20 or the like or the vicinity thereof, such as a site outside of the upper contact part 131 in the third embodiment in the radial direction or a site continuously provided outside of the upper contact part 21 or the like in the radial direction as described in the first to fifth embodiments.

The three or more intermediate parts 13 or 63 may be provided along the circumference of the operation key 10 or 60. In this case, the three or more band parts 25 or 75 may be provided in accordance with the number of intermediate parts 13 or 63.

The various substrates 40 according to the first embodiment illustrated in FIG. 4 may be selectively employed also in the second to fifth embodiments. Similarly, the various operation keys 60 illustrated in FIGS. 8 to 10 may be selectively employed in the first and third to fifth embodiments.

The outer contact parts 26 and 166 protruding toward the substrate 40 are not necessarily needed. Similarly, the intermediate parts 13 and 63 are not necessarily needed. When an illumination means such as the LED 50 is not disposed inside of the movable contact 20 or the like, the first through-holes 22, 72, 132, 162, and 192 are not necessarily needed. For example, in the first embodiment, the recess 17 does not need to be formed in the key body 11 when the pusher 16 does not contact with the LED 50. The at least two contacts are not limited to the first and second contacts 41 and 42, but may include the second contacts 42*a* and 42*a* only or the first contacts 41*b* and 41*b* only. When the number of times of contact of the movable contact 20 or the like with the contacts 41 and 42 is two, the number of times of conduction may be one or two depending on the manner of the contact.

Various components of the pushbutton switch members 30, 80, 110, 140, 170, and 200 according to the first to fifth embodiments may be optionally combined with each other unless the combination is inconsistent. For example, the structures according to the first and second embodiments may be combined with each other such that the movable contact 70 having a circular shape in plan view is fixed to the operation key 10 having a rectangular shape in plan view. Similarly, the structures according to the fourth and fifth embodiments may be combined with each other such that the movable contact 190 having a circular shape in plan view is fixed to the operation key 150 having a rectangular shape in plan view. The airflow paths 158 according to the fourth embodiment may be provided in the first to third and fifth embodiments.

Sixth to Eighth Embodiments

In a conventionally known pushbutton switch member, a switch is turned on through deformation of a metal dome when pushing is applied on a central top part of the metal dome (see Japanese Patent Laid-open No. 10-188728, for example). Along with downsizing of keys and spaces therebetween due to recent downsizing of an instrument in which a pushbutton switch member is incorporated, it has been increasingly required to highly accurately achieve positioning between each key and the metal dome. For example, when a positional difference occurs between a pushing position on the key and the central top part of the metal dome, a favorable click feeling cannot be obtained. To solve such a problem, a pushbutton switch member has been developed in which the central top part of the metal dome is adhered directly below the key with adhesive agent (see WO 2012/153587, for example). When the metal dome is adhered directly below the key, the positions of the key and the metal dome are fixed so that the central top part of the metal dome can be reliably pushed, and thus a favorable click feeling can be obtained.

In particular, a circuit board is provided with a first fixed contact configured to contact with the center of the metal dome, and a second fixed contact configured to contact with the outer periphery of the metal dome, and the metal dome is connected with the key while floating above the circuit board. This configuration achieves such a two-staged switch that, when the metal dome is pushed down through the key, the outer periphery of the metal dome contacts with the second fixed contact to turn on a switch, and subsequently, a central part of the metal dome contacts with the first fixed contact to turn on another switch.

However, in the pushbutton switch member disclosed in JP 10-188728, a rubber switch is only disposed above the metal dome, a positional difference between the rubber switch and the metal dome is likely to occur. In addition, a stroke until the metal dome deforms to turn on a switch since start of pushing is short. Such a positional difference and a short stroke degrade operation feeling and thus are not preferable.

In the pushbutton switch member disclosed in WO 2012/153587, a pusher directly below an operation key is adhered to a top part of the metal dome, and thus the above-described positional difference problem does not occur, but another problem attributable to adhesive agent used in the adhesion occurs. The other problem is such that dimensional tolerance in a pushing direction is large due to variation in the thickness of the adhesive agent, which makes it difficult to reliably provide a favorable operation feeling. In addition, the metal dome is unlikely to deform where the adhesive agent exists, and thus a strong click feeling that would be otherwise provided by the metal dome is unlikely to be obtained.

To solve the above-described problems, the inventors first developed a pushbutton switch member in which a pusher directly below an operation key is spaced apart from a top part of an inverted cup-shaped movable contact such as a metal dome, and the outer periphery of the movable contact is fixed outside of the pusher of the operation key in the radial direction. In this pushbutton switch member, a distance by which the pusher moves to contact with the top part of the metal dome contributes to a stroke from start of pushing until switch inputting. Accordingly, a more favorable click feeling can be achieved by adjusting, while maintaining the length of the stroke, a load due to pushing of the operation key to more smoothly increase until the metal dome connects with a contact.

However, it was found that problems described below need to be discussed to develop a high-performance pushbutton switch member. One of the problems is that an adhesion area between the key and the metal dome is so small that sufficient adhesion force cannot be obtained by adhesion through adhesive agent, which causes peeling of the key and the metal dome in some cases. Another one of the problems is that it is difficult to apply adhesive agent at a uniform thickness, and thus sufficient adhesion force cannot be obtained at part of an adhesion region in some cases. The other problem is that overflow of adhesive agent is likely to occur between the key and the metal dome, which encumbers deformation of the metal dome and degrades a switch feeling in some cases.

Embodiments described below are intended to further improve the performance of a pushbutton switch member developed earlier by the inventors and provide a pushbutton switch member reliably achieving a long stroke and a strong click feeling that should be provided by a dome-shaped movable contact and capable of achieving further improvement of adhesion force between the dome-shaped movable contact and a key and further improvement of a switch feeling.

To achieve the above-described intention, a pushbutton switch member according to an embodiment is a pushbutton switch member including: a dome-shaped movable contact including an inverted cup-shaped part protruding in an inverted cup shape and an outer extension part outside of the inverted cup-shaped part in a radial direction; and an operation key disposed on a protrusion side of the movable contact, the operation key being opposite to and spaced apart from the movable contact. Pushing the operation key toward the movable contact causes an electrical connection between the movable contact and a contact on a substrate disposed in a direction in which the movable contact is pushed. The operation key includes: a key body; a foot part disposed outside of the key body in the radial direction, fixed on the substrate, and connected with the key body; and a fixation sheet covering at least a portion of a surface of the outer extension part and fixing at least a portion of the outer extension part to the foot part.

In the pushbutton switch member according to another embodiment, the operation key may further include a dome part positioned between the key body and foot part and deformable by pushing of the key body toward the substrate.

In the pushbutton switch member according to another embodiment, the fixation sheet may include an insulating substrate and an adhesion layer provided on one surface of the insulating substrate, and may be disposed such that the adhesion layer covers the surface of the outer extension part and the foot part.

In the pushbutton switch member according to another embodiment, the foot part may include a first recess recessed in a direction departing from the substrate, at least a portion of the outer extension part may be disposed in the first recess, and the fixation sheet may be fixed to the foot part to cover the surface of the outer extension part.

In the pushbutton switch member according to another embodiment, the outer extension part may include a flat part spreading flatly outward in the radial direction from a peripheral edge of the inverted cup-shaped part, and an extension part extending outside of the flat part in the radial direction, and the extension part extends from the flat part to the first recess.

In the pushbutton switch member according to another embodiment, the first recess may further include a second recess recessed in a direction departing from the substrate, and the extension part may be housed in the second recess.

In the pushbutton switch member according to another embodiment, a surface of the fixation sheet, which is opposite to the outer extension part may contact with the substrate.

In the pushbutton switch member according to another embodiment, the movable contact may be provided with a first through-hole in a region including a central part thereof in plan view, and may contact with the key body at the periphery of the first through-hole when the operation key is pushed in.

In the pushbutton switch member according to another embodiment, light from an illumination means provided inside of the contact on the substrate in the radial direction may be transmitted through the first through-hole.

In the pushbutton switch member according to another embodiment, the movable contact may include a protrusion protruding toward the contact on the substrate.

The following describes embodiments of a pushbutton switch member according to the present invention with reference to the accompanying drawings. The embodiments described below are not intended to limit the invention according to the claims, and not all elements and combinations thereof described in the embodiments are necessarily essential to solution of the present invention. In the following, a direction "outward in the radial direction" means a direction in which the radius of a virtual circle about the center of a particular object in plan view increases. A direction "inward in the radial direction" means a direction in which the radius of the virtual circle decreases. "Plan view" means a view from above a surface of the substrate, on which the pushbutton switch member is disposed.

Sixth Embodiment

Figure 16:
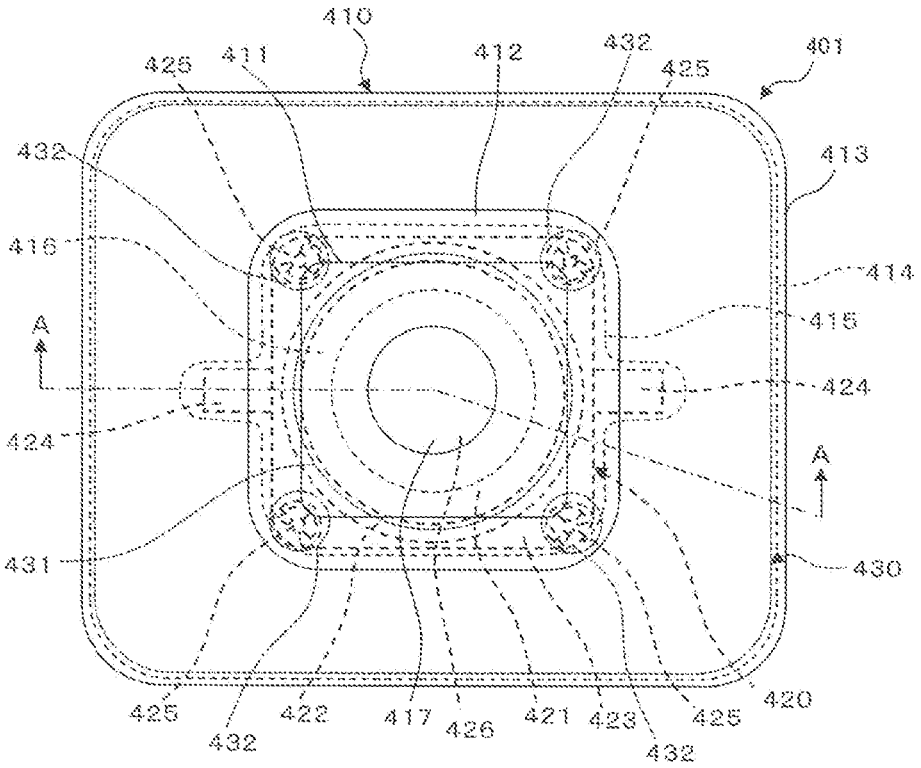
FIG. 16 illustrates a transparent plan view of an operation key included in a pushbutton switch member according to a sixth embodiment.
Figure 17A:
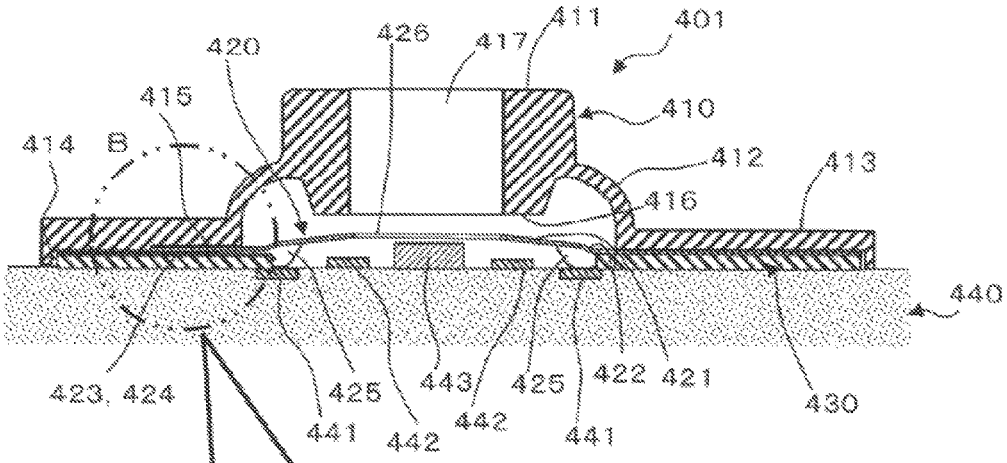
FIG. 17A illustrates a line A-A cross-sectional view of the pushbutton switch member illustrated in FIG. 16.
Figure 17B:
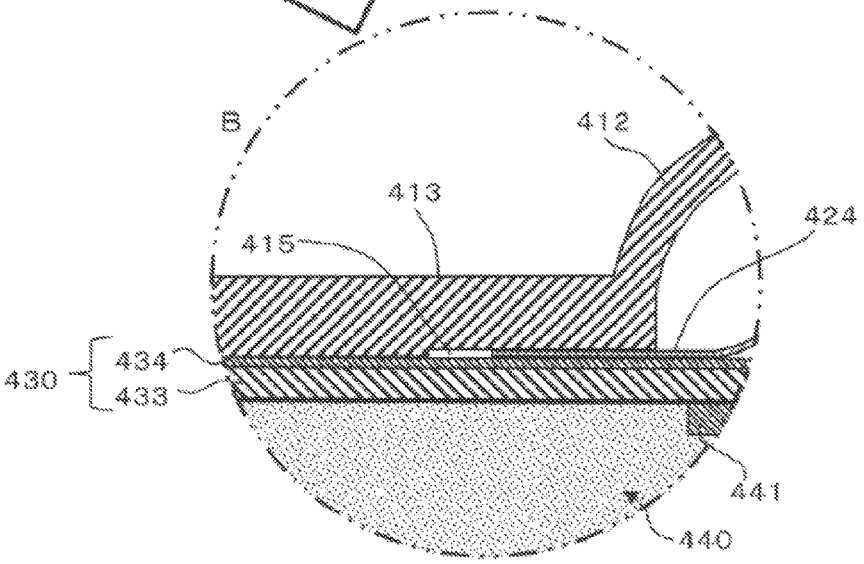
FIG. 17B illustrates an enlarged cross-sectional view of part B.
Figure 18A:
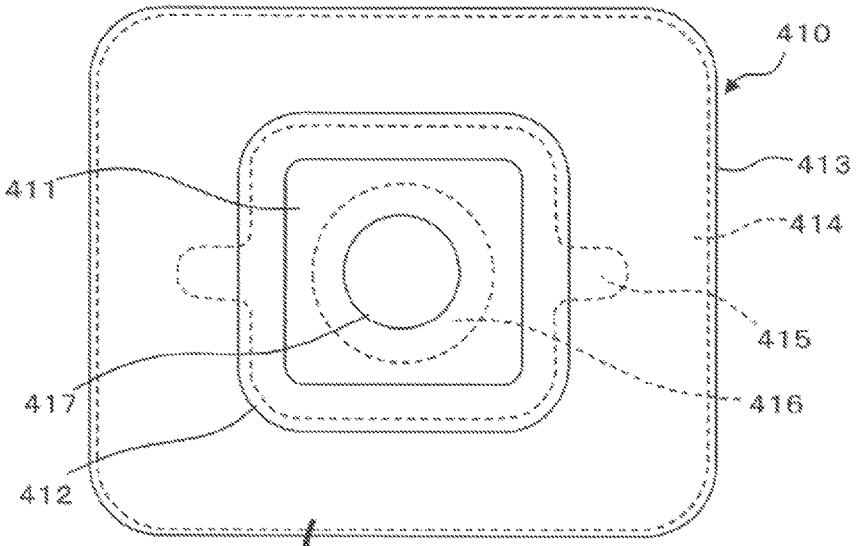
FIGS. 18A-18C illustrate plan views of each component included in the pushbutton switch member illustrated in FIG. 16.
Figure 18B:
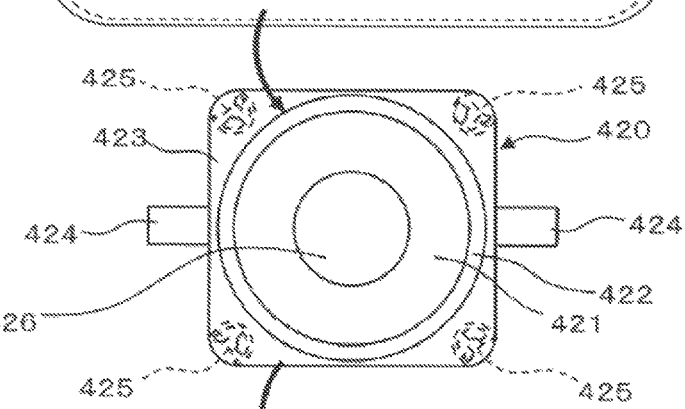
Figure 18C:
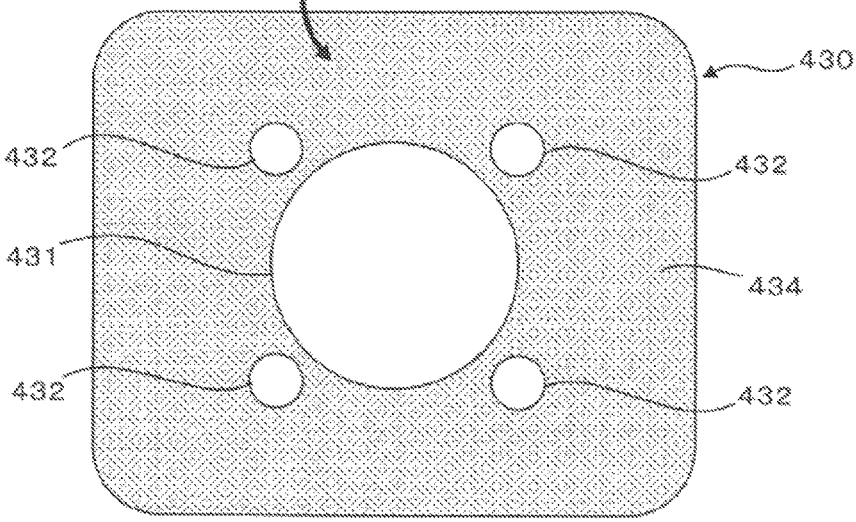

FIG. 16 illustrates a transparent plan view of an operation key included in a pushbutton switch member according to a sixth embodiment. FIG. 17A illustrates a line A-A cross-sectional view of the pushbutton switch member illustrated in FIG. 16, and FIG. 17B illustrates an enlarged cross-sectional view of part B. FIGS. 18A-18C illustrate plan views of each component included in the pushbutton switch member illustrated in FIG. 16. In FIGS. 18A-18C, the components are placed over each other as indicated by black bold arrows. This notation also applies to FIGS. 21A-21C and 24A-24C to be described later.

The pushbutton switch member 401 according to the sixth embodiment includes a dome-shaped movable contact (hereinafter simply referred to as a "movable contact") 420, and an operation key 410 disposed on a protrusion side of the movable contact 420, the operation key 410 being opposite to and spaced apart from the movable contact 420. Pushing the operation key 410 toward the movable contact 420 causes the movable contact 420 to contact with contacts 442, 442 (including contacts 441, 441) on a substrate (also referred to as a "circuit board") 440 disposed in a direction in which the movable contact 420 is pushed, thereby achieving electrical connection between the contacts 442, 442 and the like.

(1) Operation Key

The operation key 410 includes a key body 411, and a foot part 413 disposed outside of the key body 411 in the radial direction and fixed on the substrate 440, the key body 411 and the foot part 413 being connected with each other. In the present embodiment, the operation key 410 preferably further includes a dome part 412 positioned between the key body 411 and the foot part 413 and deformable by pushing of the key body 411 toward the substrate 440. The key body 411, the dome part 412, and the foot part 413 have substantially rectangular shapes in plan view as illustrated in FIG. 16. The foot part 413 is disposed on the substrate 440 such that an outer peripheral edge thereof in plan view contacts with the substrate 440 while a region inner side of this outer peripheral edge in the radial direction floats above the substrate 440. In the present embodiment, the region in which the foot part 413 floats above the substrate 440 is referred to as a first recess 414 recessed in a direction departing from the substrate 440. The first recess 414 is a site to which an outer extension part of the movable contact 420 to be described later can be partially or entirely fixed. In the present embodiment, the first recess 414 preferably further includes a second recess 415 recessed in a direction departing from (the up direction in FIG. 17A) the substrate 440. The second recess 415 is a site in which an extension part of the movable contact 420 to be described later is housed. The housing favorably includes a state in which the extension part sinks in the second recess 415 in the thickness direction of the extension part. In this manner, the foot part 413 has a structure recessed at two stages in which the first recess 414 is recessed toward inside of the foot part 413 from the substrate 440 and the second recess 415 is recessed inward of the first recess 414.

The key body 411 includes a pushing part 416 as a bottom surface facing to the movable contact 420. The pushing part 416 has a substantially circular shape in plan view. In the present embodiment, the pushing part 416 is not in contact with the movable contact 420 when the operation key 410 is not pushed toward the movable contact 420. However, the pushing part 416 may be in contact with the movable contact 420 in this state. In the present embodiment, the pushing part 416 is not fixed to the movable contact 420. The key body 411 is provided with a through-hole 417 penetrating from a top surface thereof to a bottom surface thereof. In the present embodiment, the through-hole 417 has a substantially circular shape in plan view. The through-hole 417 transmits light from an illumination means to be described later to a space above the key body 411, and prevents contact between the illumination means and the pushing part 416 when the key body 411 is pushed in toward the substrate 440. However, the through-hole 417 may be replaced with a highly translucent member, and when the contact with the illumination means needs to be prevented, a recess least necessary for preventing the contact may be formed inward from the bottom surface of the key body 411.

The operation key 410 is preferably made of thermosetting elastomer such as silicone rubber, urethane rubber, isoprene rubber, ethylene propylene rubber, natural rubber, or ethylene propylene diene rubber; thermoplastic elastomer such as urethane series, ester series, styrene series, olefin series, butadiene series, or fluorine series; or any compound thereof. Examples of the material of the operation key 410 other than those described above include styrene butadiene rubber (SBR) and nitrile rubber (NBR). The above-described materials may be mixed with a filler such as titanium oxide or carbon black with colorant.

(2) Movable Contact

The movable contact 420 is shaped in a rectangle (including a square) in plan view, and is a dome-shaped contact including an inverted cup-shaped part 421 protruding in an inverted cup shape and the outer extension part outside of the inverted cup-shaped part 421 in the radial direction. The inverted cup-shaped part 421 is a thin part protruding toward the key body 411 and recessed on the substrate 440 side. In the present embodiment, the inverted cup-shaped part 421 has a substantially circular shape in plan view. In the present embodiment, the inverted cup-shaped part 421 is provided with, in a protruding region, a first through-hole 426 having a substantially circular shape in plan view. When the key body 411 is pushed toward the substrate 440, the pushing part 416 of the key body 411 contacts with the inverted cup-shaped part 421 and deforms the movable contact 420. As a result, an outer peripheral edge region of the first through-hole 426 of the inverted cup-shaped part 421 contacts with the contacts 442, 442 on the substrate 440. The movable contact 420 electrically connects the two contacts 442, between which there has been no conduction, thereby causing electrical connection between the two contacts 442, 442. The contacts 442, 442 may have any shapes as long as the contacts 442, 442 are provided on the substrate 440 while avoiding conduction therebetween. Examples of the shapes of the contacts 442 include a rectangular shape, a semi-ring shape, a ring shape, and a comb-teeth shape.

The movable contact 420 includes a stepped part 422 outside of the inverted cup-shaped part 421 in the radial direction. In the present embodiment, the stepped part 422 has a substantially circular shape in plan view. The stepped part 422 is connected with the outer extension part outside of the stepped part 422 in the radial direction. The stepped part 422 tilts from a peripheral edge part of the inverted cup-shaped part 421 toward the substrate 440 and from this peripheral edge part outward in the radial direction, and connects the inverted cup-shaped part 421 with the outer extension part, which is closer to the substrate 440 than the inverted cup-shaped part 421. When the key body 411 is pushed toward the substrate 440 and force toward the substrate 440 is applied on the inverted cup-shaped part 421 of the movable contact 420, the inverted cup-shaped part 421 deforms at the stepped part 422.

At least a portion of the outer extension part is disposed in the first recess 414. In the present embodiment, the outer extension part includes a flat part 423 spreading flatly outward in the radial direction from a peripheral edge of the inverted cup-shaped part 421, and an extension part 424 outside of the flat part 423 in the radial direction. In the present embodiment, the flat part 423 is a plate member having a substantially rectangular shape in plan view and connected with the stepped part 422. In the present embodiment, the extension parts 424 are a total of two of plate members provided at a pair of facing sides of the flat part 423. The extension part 424 is also referred to as a strip-shaped part extending in a narrow strip shape outward from the two facing sides. The extension part 424 extends from the flat part 423 to the first recess 414 of the foot part 413, and more specifically, has such a shape that the extension part 424 can be housed in the second recess 415. The extension part 424 may have a length that does not reach an outer leading end of the second recess 415. The extension part 424 preferably has a length substantially equal to a groove depth of the second recess 415. In particular, the second recess 415 is preferably set to have such a depth that a surface of the extension part 424 on the substrate 440 side is flush with a surface of the first recess 414 on the substrate 440 side when the extension part 424 is housed in the second recess 415. This is because the extension part 424 and the first recess 414 can be fixed in a substantially flat state with no step when a fixation sheet 430 to be described later is attached to the first recess 414 of the operation key 410. Such fixation contributes to solid fixation of the movable contact 420 to the operation key 410.

The flat part 423 includes four convex parts 425 protruding toward the substrate 440 substantially at four corners in plan view on a surface facing to the substrate 440. The convex parts 425 are formed at positions facing to the contacts 441, 441 positioned outside of the contacts 442, 442 on the substrate 440 in the radial direction. In the present embodiment, the convex parts 425 of the movable contact 420 are not in contact with the contacts 441, 441 when the key body 411 is not pushed toward the substrate 440. The four convex parts 425 contact with the contacts 441, 441 when the key body 411 is pushed toward the substrate 440. Accordingly, conduction is achieved between the contacts 441, 441 through the movable contact 420. When the key body 411 is further pushed in toward the substrate 440, a peripheral edge part of the first through-hole 426 of the inverted cup-shaped part 421 contacts with the contacts 442, 442. In this manner, a two-staged switch can be turned on and off in accordance with a distance by which the key body 411 is pushed in toward the substrate 440. To achieve such a function, it is preferable that the distances between the convex parts 425 and the contacts 441 are shorter than the distances between the peripheral edge part of the first through-hole 426 and the contacts 442 so that the four convex parts 425 contact with the contacts 441, 441, and subsequently, the inverted cup-shaped part 421 contacts with the contacts 442, 442. The contacts 441, 441 may have any shapes as long as the contacts 441 are provided on the substrate 440 while avoiding conduction therebetween. Examples of the shapes of the contacts 441 include a rectangular shape, a semi-ring shape, a ring shape, and a comb-teeth shape.

In the present embodiment, the inverted cup-shaped part 421 is provided with, in the protruding region of the inverted cup-shaped part 421, the first through-hole 426 having a substantially circular shape in plan view. With this configuration, the movable contact 420 is provided with the first through-hole 426 in a region including a central part thereof in plan view, and contacts with the key body 411 at the vicinity of the first through-hole 426 when the operation key 410 is pushed in. The first through-hole 426 guides light from an LED 443 as an exemplary illumination means disposed between the contacts 442, 442 on the substrate 440, outward from the movable contact 420 through the through-hole 417 of the key body 411. In other words, the movable contact 420 has such a structure that light can be transmitted through the first through-hole 426 from the LED 443 provided inside of the contacts 441, 441 on the substrate 440 in the radial direction. In the present embodiment, the first through-hole 426 has a size substantially equal to that of the through-hole 417 of the key body 411. However, the first through-hole 426 may have a diameter smaller or larger than that of the through-hole 417. In particular, the first through-hole 426 more preferably has a diameter smaller than that of the through-hole 417 to avoid shielding of light from the illumination means by the pushing part 416.

The movable contact 420 is preferably made of a material same as that of the movable contact 20 according to the above-described embodiment and provided with the same surface treatment such as plating and evaporation coating. The extension part 424 of the movable contact 420 is fixed to the foot part 413 of the operation key 410 so that the four convex parts 425 included in the flat part 423 are not in contact with the contacts 441, 441 and the peripheral edge part of the first through-hole 426 of the inverted cup-shaped part 421 is not in contact with the contacts 442, 442.

(3) Fixation Sheet

The fixation sheet 430 covers a surface of at least part (for example, the extension part 424) of the outer extension part of the movable contact 420, and fixes at least a portion of the outer extension part to the foot part 413. More specifically, the fixation sheet 430 covers the bottom surface of the first recess 414 including the surface of the extension part 424 on the substrate 440 side, and also covers halfway through the stepped part 422. As illustrated in FIGS. 18A-18C, the fixation sheet 430 is provided with a large through-hole 431 having a substantially circular shape in plan view substantially at the center thereof, and four small through-holes 432 around the large through-hole 431. The large through-hole 431 has a size enough to expose a large part of the inverted cup-shaped part 421 of the movable contact 420. The four small through-holes 432 are positioned at the four convex parts 425 of the movable contact 420, and each have a size that allows the corresponding convex part 425 to penetrate through the small through-hole 432.

As illustrated in FIGS. 17A and 17B, the fixation sheet 430 includes an insulating substrate 433, and an adhesion layer 434 provided on one surface of the insulating substrate 433. The fixation sheet 430 is disposed such that the adhesion layer 434 covers the foot part 413 from above the outer extension part of the movable contact 420. More specifically, the fixation sheet 430 is preferably fixed to the foot part 413 to cover from above the outer extension part in contact with the first recess 414. The fixation sheet 430 is preferably adhered to the first recess 414 of the foot part 413 such that a surface opposite to the outer extension part (in other words, a surface on the insulating substrate 433 side) contacts with the substrate 440. This configuration effectively prevents such a situation that the extension part 424 housed in the second recess 415 falls off the second recess 415 and moves to the substrate 440 side due to repetitive pushing of the operation key 410.

The adhesion layer 434 preferably has a substantially flat shape without partially protruding toward the substrate 440. To achieve this, it is preferable that the thickness of the extension part 424 of the movable contact 420 is substantially equal to the depth of the second recess 415. When the fixation sheet 430 is attached to the first recess 414, the extension part 424 and the first recess 414 are fixed to each other in a substantially flat state with no step to prevent air from entering around the extension part 424, thereby achieving close contact between the adhesion layer 434 of the fixation sheet 430 and the extension part 424. This configuration also prevents degradation of conductivity due to contamination of the substrate 440 by adhesive agent and degradation of switch feeling and durability due to a longer stroke than designed.

The insulating substrate 433 is favorably made of various resins such as polyolefin, polyamide, polyimide, polyester, polycarbonate, fluorine resin, polyphenylene sulfide, and acrylic resin. The adhesion layer 434 may contain gluing agent in addition to adhesive agent. The thickness of the fixation sheet 430 is not particularly limited, but may be preferably 15 to 500 μm, more preferably 20 to 300 μm, still more preferably 30 to 200 μm. When the movable contact 420 does not include the flat part 423 but connects the inverted cup-shaped part 421 and the extension part 424 through the stepped part 422, the thickness of the fixation sheet 430 is preferably 200 μm or smaller, more preferably 100 μm or smaller, to improve switch inputting performance and durability of the fixation sheet 430.

The fixation sheet 430 may be manufactured by combining the insulating substrate 433 and the adhesion layer 434 as desired or by using a commercially available film with gluing agent or a commercially available film with adhesive agent. For example, a PET film with silicone gluing agent (or adhesive agent), a polyphenylene sulfide film with silicone gluing agent (or adhesive agent), a polyimide film with silicone gluing agent (or adhesive agent), a fluorine resin film with silicone gluing agent (or adhesive agent), and a polyester film with acrylic gluing agent (or adhesive agent) are available in the market. When thermal resistance or chemical resistance is required, the insulating substrate 433 is preferably made of polyphenylene sulfide, polyimide, or fluorine resin. When the fixation sheet 430 including the adhesion layer 434 containing gluing agent (or adhesive agent) other than silicone gluing agent (or adhesive agent) is used, it is preferable that at least a surface of the foot part 413, which is adhered to the fixation sheet 430 is provided with urethane coating treatment, surface reforming treatment (such as ultraviolet irradiation treatment, corona treatment, plasma irradiation treatment, frame treatment, or Itro treatment) to improve fixation to the operation key 410.

In this manner, when the extension part 424 or the flat part 423 including the extension part 424 is sandwiched and fixed between the fixation sheet 430 and the first and second recesses 414 and 415 of the foot part 413, an overflow risk of adhesive agent or an ununiform thickness risk of adhesive agent can be reduced. When the operation key 410 and the movable contact 420 inevitably have a small adhesion area therebetween due to the shapes thereof, a risk that the movable contact 420 falls off the operation key 410 can be reduced by sandwiching the extension part 424 and the like between the second recess 415 and the fixation sheet 430. Adhesion strength decrease due to restriction on the shape of the movable contact 420 can be minimized by fixing the movable contact 420 to a back surface (surface facing to the substrate 440) of the foot part 413 of the operation key 410.

(4) Substrate

The substrate 440 is provided with the contacts 441, 441 and 442, 442 (exemplary contacts) on the surface thereof. The substrate 440 is made of a highly insulating material. Favorable examples of such a substrate include a paper phenol substrate obtained by solidifying a paper substrate with phenol resin, a paper epoxy substrate obtained by solidifying a paper substrate with epoxy resin, a glass epoxy substrate obtained by solidifying, with epoxy resin, cloth woven from glass fibers, a glass composite substrate obtained by mixing and solidifying paper and a glass substrate, a ceramic substrate made of highly insulating ceramic such as alumina, and a resin substrate made of highly insulating resin such as tetrafluoroethylene or polyimide.

Although FIGS. 17A and 17B illustrate the two contacts 441, 441, the number of contacts 441 may be same as the number of convex parts 425 (in other words, four). At least two contacts 442, 442 need to be provided, and thus three or more contacts 442 may be provided. The numbers and shapes of the contacts 441, 441 and 442, 442 in FIGS. 17A and 17B are merely exemplary, and the contacts may be provided in any numbers and shapes as long as the contacts are configured to be energized through contact with the convex parts 425 and contact with an outer peripheral edge part of the first through-hole 426, respectively. Although the contacts 441, 441 are buried inside the substrate 440 with the surfaces thereof being exposed and the contacts 442, 442 are adhered on the substrate 440, a reversed configuration may be possible, all contacts may be adhered on the substrate 440, or all contacts may be buried inside the substrate 440 with the surfaces thereof being exposed. In the present embodiment, the contacts 441, 441 and the contacts 442, 442 are both provided, but in a one-staged switch, for example, only any one pair of the contacts 441, 441 and the contacts 442, 442 need to be provided.

In the present embodiment, the LED 443 as an exemplary illumination means is provided at a predetermined position on the substrate 440 facing to the first through-hole 426 of the movable contact 420. The LED 443 has a light emission surface facing to the first through-hole 426. Examples of an illumination means other than the LED 443 include a light bulb provided with a heat filament, an organic EL (electroluminescence), and an inorganic EL. Similarly to the contacts 441 and contacts 442, an illumination means such as the LED 443 may be buried in the substrate 440, not on the surface of the substrate 440.

Seventh Embodiment

The following describes a pushbutton switch member according to a seventh embodiment. In the seventh embodiment, any component identical to that in the sixth embodiment is denoted by an identical wording and/or reference sign, and any duplicate description thereof will be omitted but should be given by referring to the description in the sixth embodiment.

Figure 19:
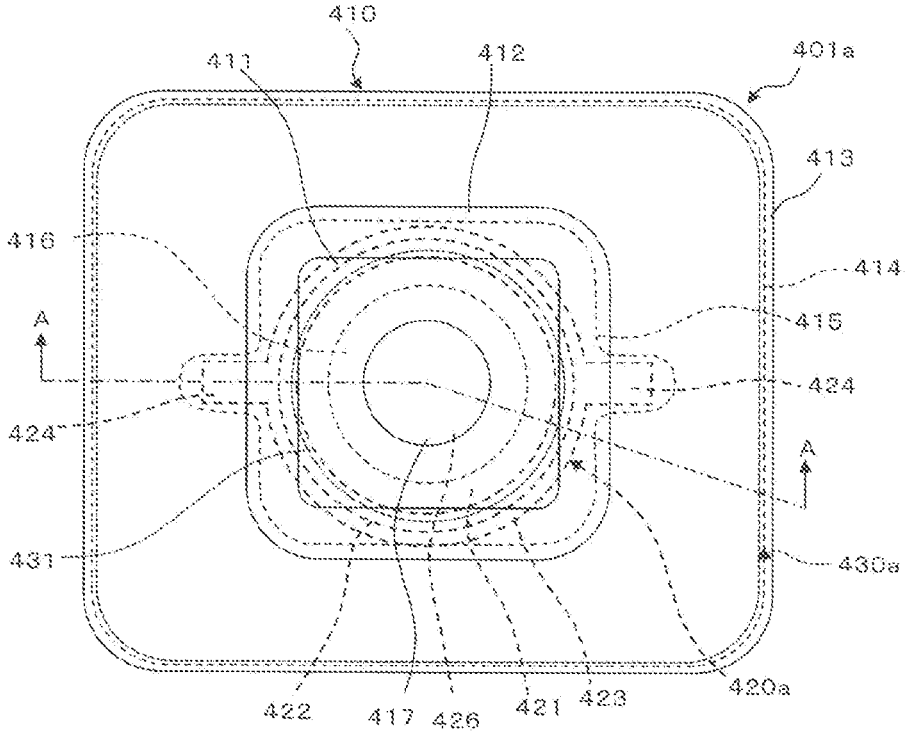
FIG. 19 illustrates a transparent plan view of an operation key included in a pushbutton switch member according to a seventh embodiment.
Figure 20A:
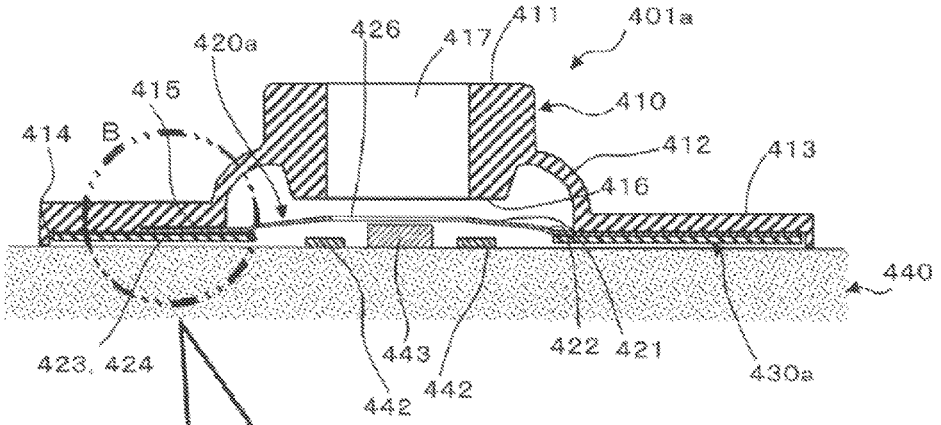
FIG. 20A illustrates a line A-A cross-sectional view of the pushbutton switch member illustrated in FIG. 19.
Figure 20B:
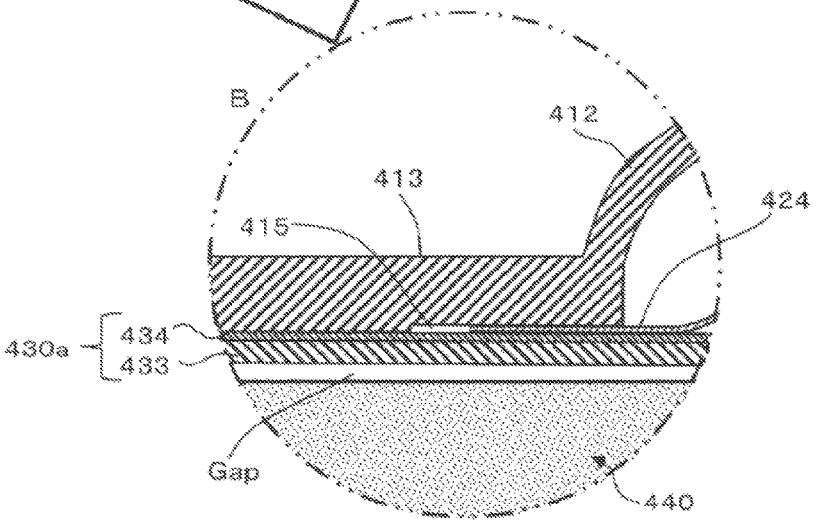
FIG. 20B illustrates an enlarged cross-sectional view of part B.
Figures 21A, 21B, 21C:
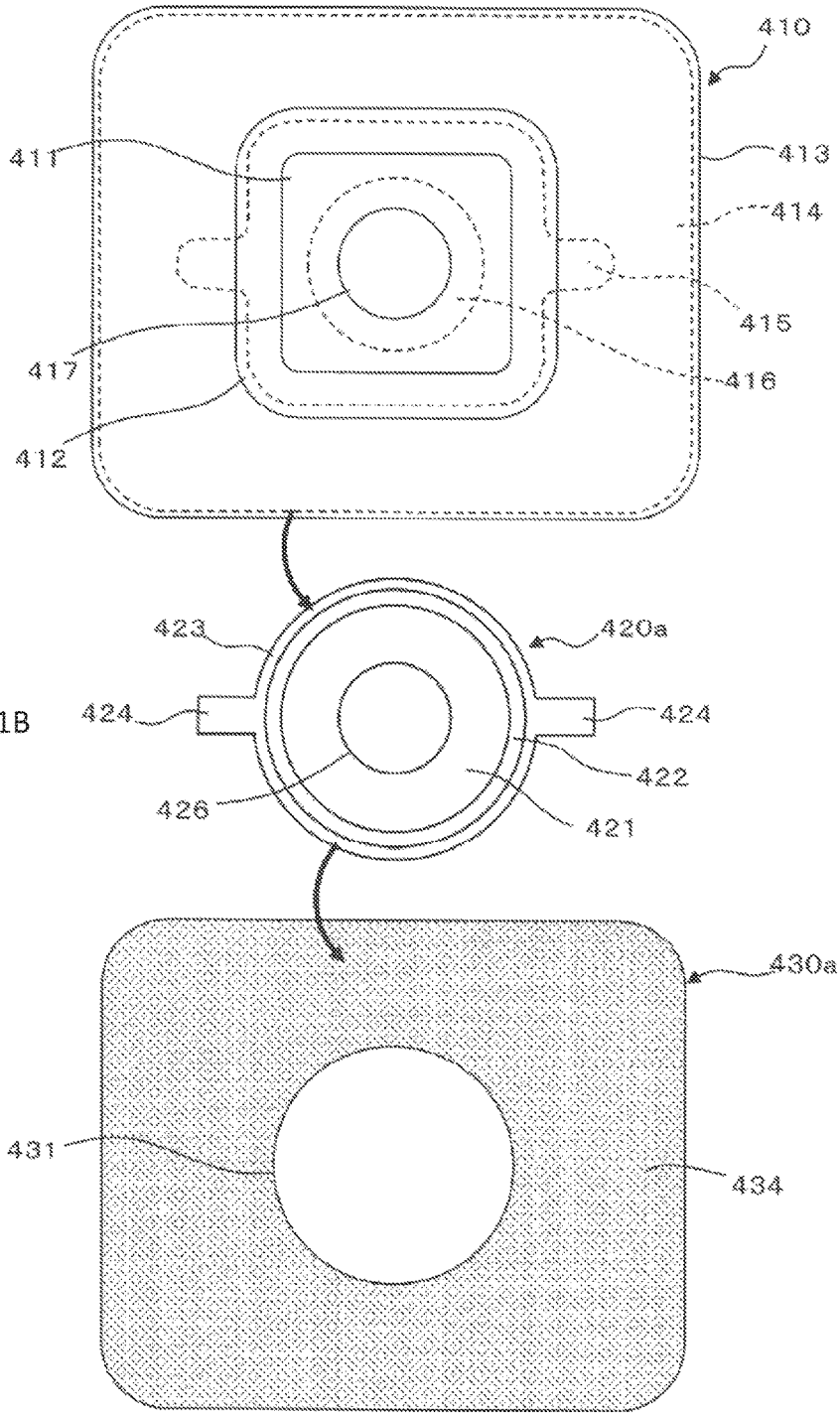
FIGS. 21A-21C illustrate plan views of each component included in the pushbutton switch member illustrated in FIG. 19.

FIG. 19 illustrates a transparent plan view of an operation key included in the pushbutton switch member according to the seventh embodiment. FIG. 20A illustrates a line A-A cross-sectional view of the pushbutton switch member illustrated in FIG. 19, and FIG. 20B illustrates an enlarged cross-sectional view of part B. FIGS. 21A-21C illustrate plan views of each component included in the pushbutton switch member illustrated in FIG. 19.

The pushbutton switch member 401*a* according to the seventh embodiment includes a movable contact 420*a* and a fixation sheet 430*a*, which are different from those in the pushbutton switch member 401 according to the sixth embodiment. In addition to these differences, no contacts 441, 441 are provided on the substrate 440. The following description of the seventh embodiment will be mainly made on any difference from the sixth embodiment, and any duplicate description of common features will be omitted below but should be given by referring to the description in the sixth embodiment.

(1) Movable Contact

The movable contact 420*a* of the pushbutton switch member 401*a* includes the flat part 423 outside of the stepped part 422 in the radial direction disposed at an outer peripheral edge of the inverted cup-shaped part 421 described in the sixth embodiment. The flat part 423 is substantially concentric with the stepped part 422. The two extension parts 424 extend outward from the flat part 423 and are disposed opposite to each other on an extended line along the radial direction of the flat part 423. Unlike the sixth embodiment, the movable contact 420*a* does not include the convex parts 425. With this configuration, only an outer peripheral edge of the first through-hole 426 contacts with the contacts 442, 442 on the substrate 440 when the operation key 410 is pushed. In other words, the pushbutton switch member 401*a* functions as a one-staged switch.

(2) Fixation Sheet

Unlike the sixth embodiment, the fixation sheet 430*a* included in the pushbutton switch member 401*a* is not provided with the small through-holes 432 through which the convex parts 425 penetrate, but is provided only with the large through-hole 431. The fixation sheet 430*a* covers surfaces of the first recess 414 of the foot part 413 and the extension part 424 housed in the second recess 415 while the insulating substrate 433 floats above the substrate 440. In other words, a gap, as illustrated in FIG. 20B exists between the fixation sheet 430*a* and the substrate 440. It is preferable that such a gap does not exist, the gap may exist when the fixation sheet 430*a* is unlikely to peel off the foot part 413.

Eighth Embodiment

The following describes a pushbutton switch member according to an eighth embodiment. In the eighth embodiment, any component identical to that in the above-described embodiments is denoted by an identical wording and/or reference sign, and any duplicate description thereof will be omitted but should be given by referring to the description in the above-described embodiments.

Figure 22:
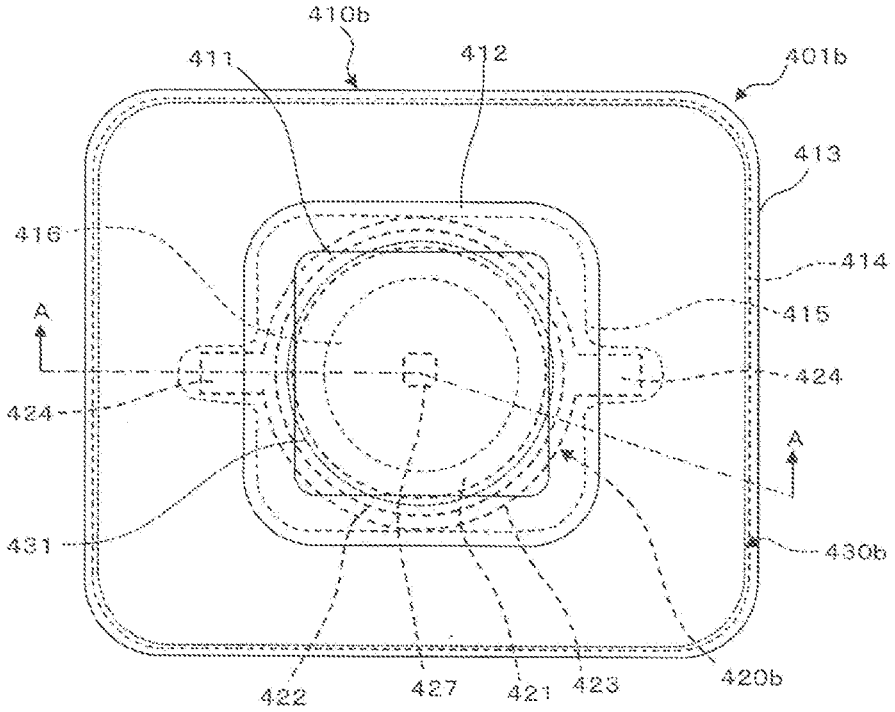
FIG. 22 illustrates a transparent plan view of an operation key included in a pushbutton switch member according to an eighth embodiment.
Figure 23A:
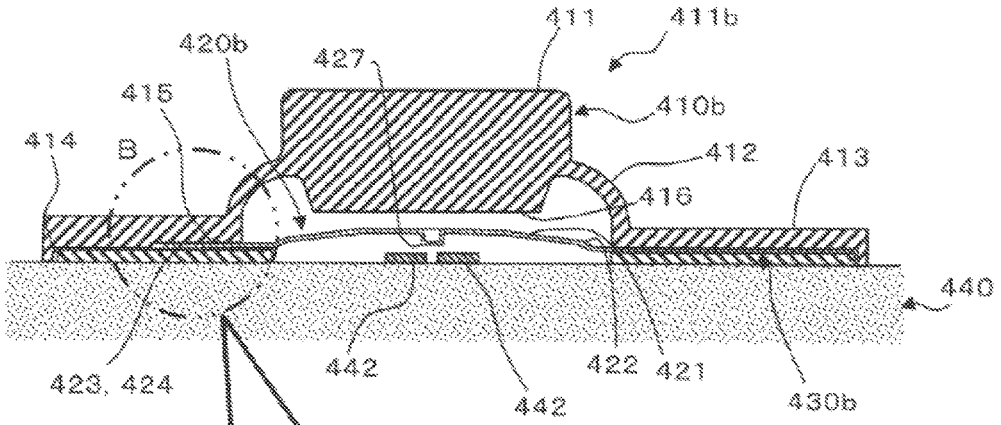
FIG. 23A illustrates a line A-A cross-sectional view of the pushbutton switch member illustrated in FIG. 22.
Figure 23B:
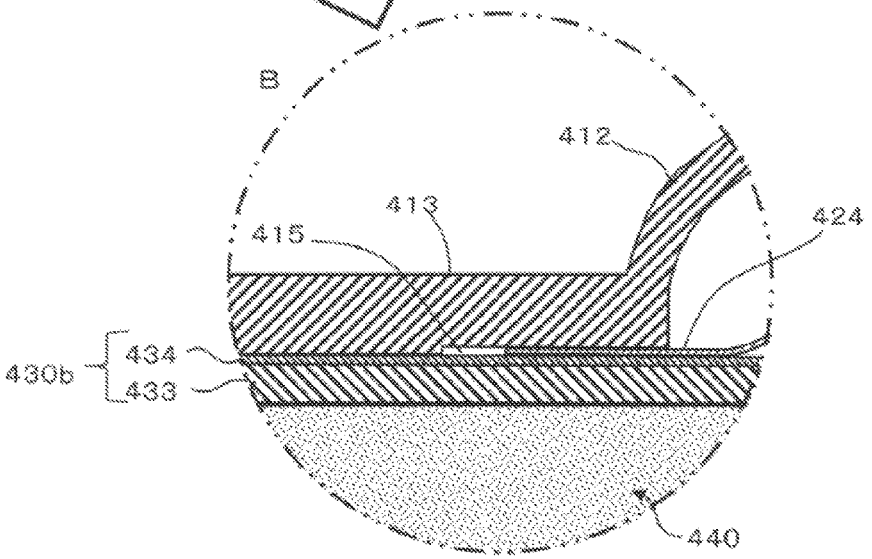
FIG. 23B illustrates an enlarged cross-sectional view of part B.
Figure 24A:
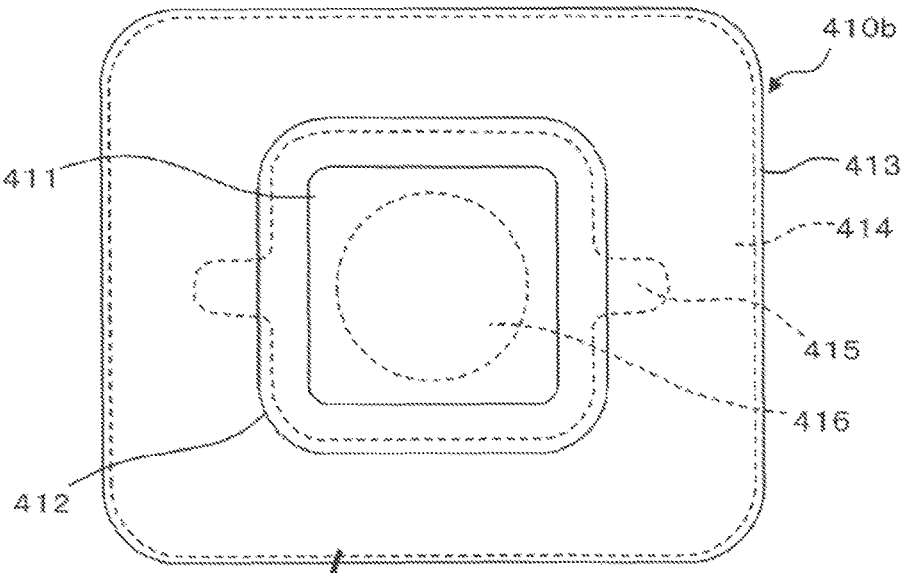
FIGS. 24A-24C illustrate plan views of each component included in the pushbutton switch member illustrated in FIG. 22.
Figure 24B:
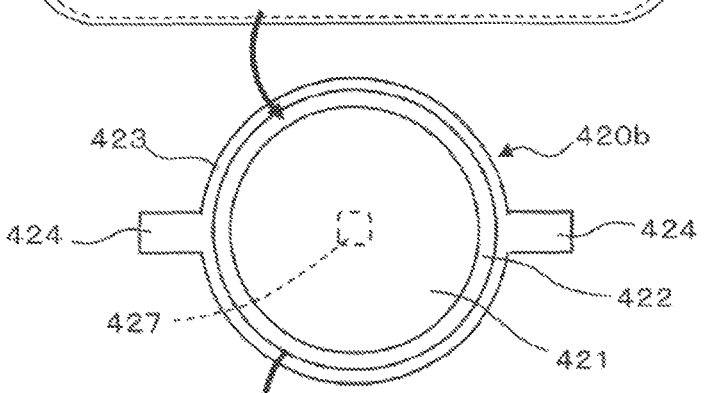
Figure 24C:
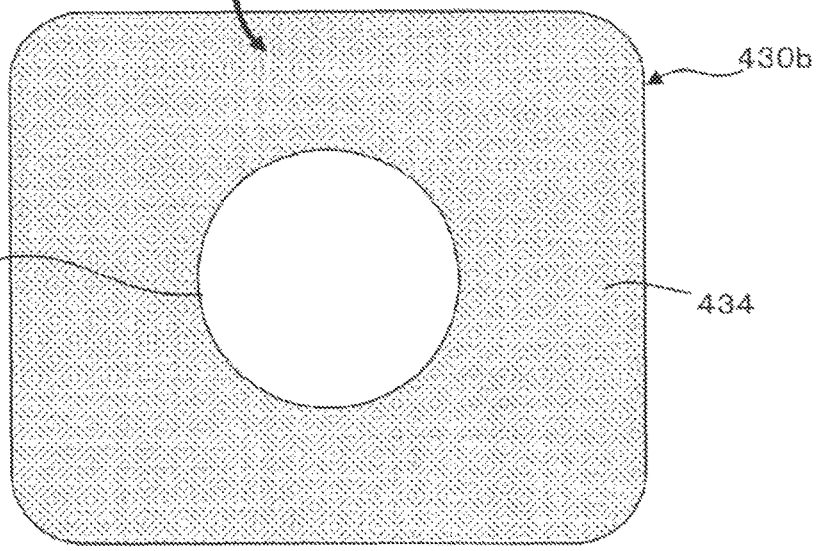

FIG. 22 illustrates a transparent plan view of an operation key included in the pushbutton switch member according to the eighth embodiment. FIG. 23A illustrates a line A-A cross-sectional view of the pushbutton switch member illustrated in FIG. 22, and FIG. 23B illustrates an enlarged cross-sectional view of part B. FIGS. 24A-C illustrate plan views of each component included in the pushbutton switch member illustrated in FIG. 22.

The pushbutton switch member 401*b* according to the eighth embodiment includes an operation key 410*b*, a movable contact 420*b*, and a fixation sheet 430*b*, which are different from those in the pushbutton switch member 401 according to the sixth embodiment. In addition to these differences, no contacts 441, 441 are provided on the substrate 440, and the distance between the contacts 442, 442 is smaller. The following description of the eighth embodiment will be mainly made on any difference from the sixth embodiment, and any duplicate description of common features will be omitted but should be given by referring to the description in the sixth embodiment.

(1) Operation Key

Unlike the sixth embodiment, the operation key 410*b* of the pushbutton switch member 401*b* does not include the through-hole 417 penetrating through the key body 411. This is because the substrate 440 does not include an illumination means and thus there is no need to transmit light from the substrate 440 side. Any other configuration except for this feature is identical to that of the sixth embodiment.

(2) Movable Contact

The movable contact 420*b* of the pushbutton switch member 401*b* includes the flat part 423 outside of the stepped part 422 in the radial direction disposed at the outer peripheral edge of the inverted cup-shaped part 421 described in the sixth embodiment. The flat part 423 is substantially concentric with the stepped part 422. The two extension parts 424 extend outward from the flat part 423 and are disposed opposite to each other on an extended line along the radial direction of the flat part 423. Unlike the sixth embodiment, the movable contact 420*b* does not include the convex parts 425 nor the first through-hole 426. This is because the substrate 440 does not include an illumination means nor the contacts 441, 441 unlike the sixth embodiment, and thus the convex parts 425 and the first through-hole 426 are unnecessary.

Unlike the sixth and seventh embodiments, the movable contact 420*b* includes, at a bottom part of a concave surface of the inverted cup-shaped part 421 (in other words, a position opposite to a protruding top surface), a protrusion 427 protruding toward the contacts 442, 442 on the substrate 440. There is no conduction between the contacts 442, 442 provided on the substrate 440. The distance between the contacts 442, 442 is small enough to electrically connect therebetween through contact with the protrusion 427. When the operation key 410*b* is pushed, the pushing part 416 of the key body 411 pushes in a top part of the inverted cup-shaped part 421 of the movable contact 420*b* toward the substrate 440. As a result, the inverted cup-shaped part 421 of the movable contact 420*b* deforms at the stepped part 422 and contacts with the contacts 442, 442 on the substrate 440. In this manner, the pushbutton switch member 401*b* functions as one-staged switch like the seventh embodiment.

(3) Fixation Sheet

Unlike the sixth embodiment, the fixation sheet 430*b* included in the pushbutton switch member 401*b* is not provided with the small through-holes 432 through which the convex parts 425 penetrate, but is provided only with the large through-hole 431. The fixation sheet 430*b* has a thickness that allows the insulating substrate 433 to contact with the substrate 440. Thus, the gap described in the seventh embodiment does not exist.

Other Embodiments

Although the preferred embodiments of a pushbutton switch member according to the present invention are described above, the present invention is not limited to the above-described embodiments, but may be modified in various manners.

Figure 25A:
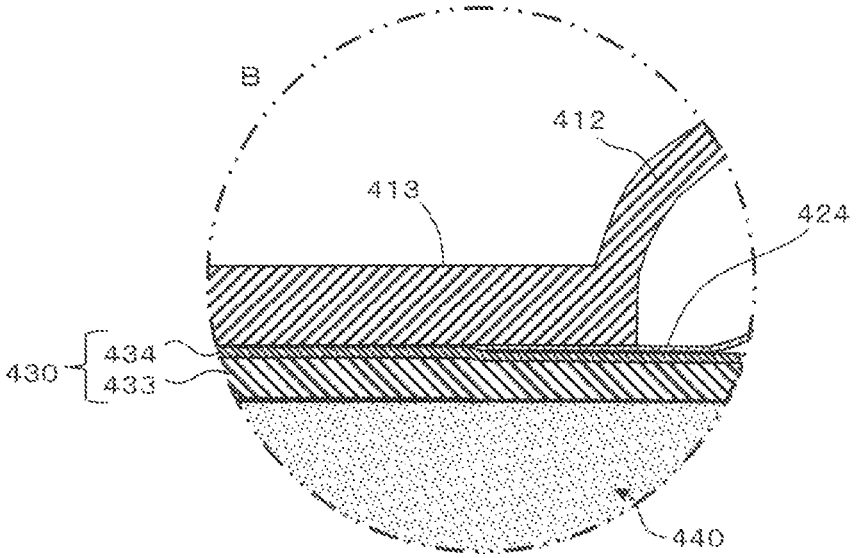
FIGS. 25A and 25B illustrate enlarged cross-sectional views (FIG. 25A and FIG. 25B) of part B in modifications of the pushbutton switch member according to the sixth embodiment, in two examples in which a foot part of an operation key is differently configured, similarly to FIGS. 17A and 17B.
Figure 25B:
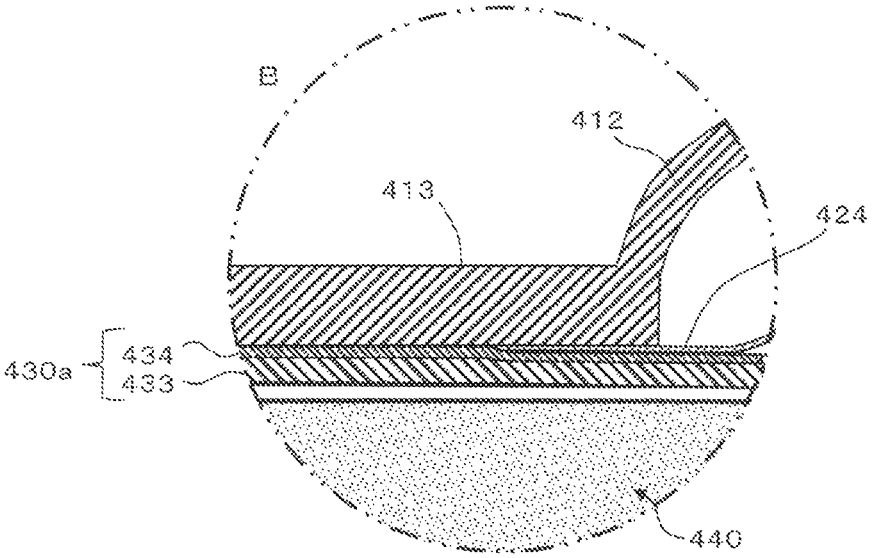
Figure 26A:
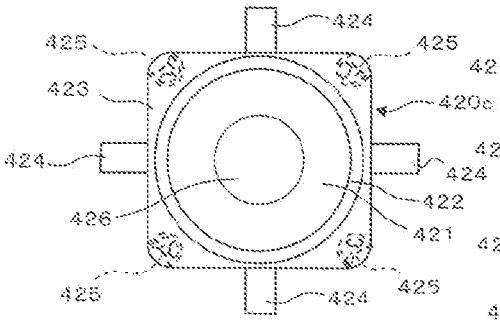
FIGS. 26A-26F illustrate various modifications (FIG. 26A to FIG. 26F) of a movable contact.
Figure 26B:
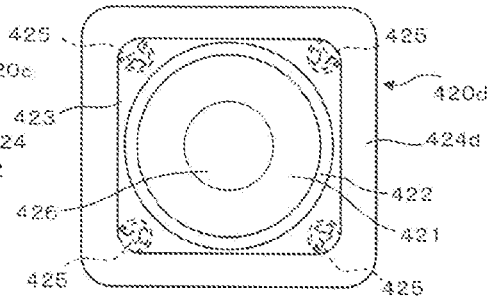
Figure 26C:
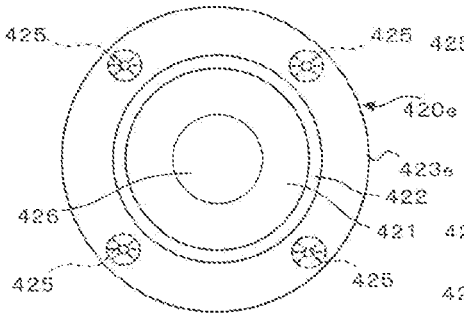
Figure 26D:
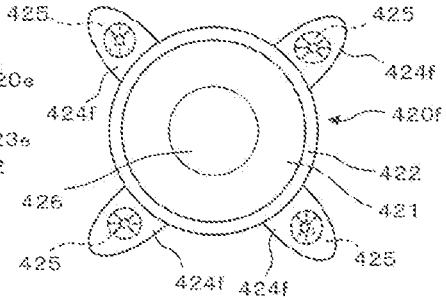
Figure 26E:
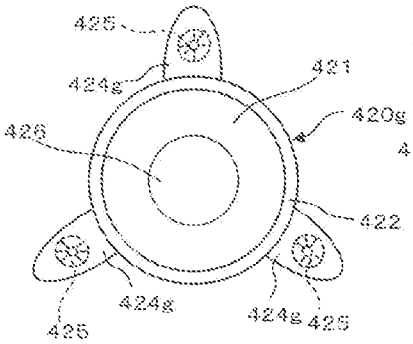
Figure 26F:
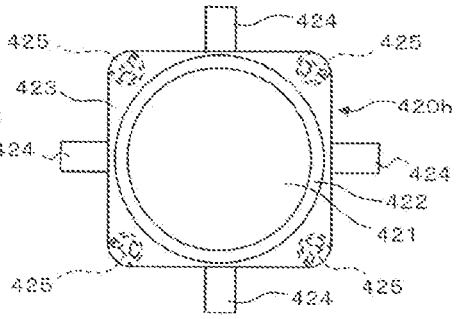

FIG. 25 illustrates enlarged cross-sectional views (25A and 25B) of part B in modifications of the pushbutton switch member according to the sixth embodiment, in two examples in which the foot part of the operation key is differently configured, similarly to FIGS. 17A and 17B.

In these modifications, the foot part 413 of the operation key 410 does not include the second recess 415, unlike the sixth embodiment. With this configuration, the extension part 424 of the movable contact 420 protrudes toward the substrate 440 from the first recess 414 of the foot part 413 by the thickness of the extension part 424. The fixation sheet 430 is fixed to the surface of the extension part 424 and the first recess 414. The adhesion layer 434 of the fixation sheet 430 is partially pushed in the insulating substrate 433 by the protrusion of the extension part 424 toward the substrate 440 from the first recess 414. However, in the example in (25A) of FIG. 25, the insulating substrate 433 is in contact with the substrate 440 unlike the example in (25B) of FIG. 25, and thus the extension part 424 is more unlikely to fall off the first recess 414. In the example in (25B) of FIG. 25, the insulating substrate 433 is spaced apart from the substrate 440, and thus the extension part 424 is more likely to fall off the first recess 414 than in the example in (25A) of FIG. 25. In the sixth embodiment, however, since the extension part 424 is housed in the second recess 415, the extension part 424 is unlikely to fall. Accordingly, it is preferable to have one of the configuration in which the second recess 415 is provided and the configuration in which the fixation sheet 430 is in contact with the substrate 440 rather than having none of the configurations, but it is more preferable to have both of the configurations.

FIG. 26 illustrates various modifications (26A to 26F) of a movable contact.

FIG. 26 illustrates, in (26A), a plan view of a movable contact 420*c* as the movable contact 420 according to the sixth embodiment to which the two oppositely disposed extension parts 424 are added. FIG. 26 illustrates, in (26B), a plan view of a movable contact 420*d* as the movable contact 420*c* in (26A) of FIG. 26 in which an extension part 424*d* is provided around the flat part 423 in place of the extension parts 424. FIG. 26 illustrates, in (26C), a plan view of a movable contact 420*e* as the movable contact 420*c* in (26A) of FIG. 26 from which the four extension parts 424 are removed and in which a flat part 423*e* having a circular ring shape is provided. FIG. 26 illustrates, in (26D), a plan view of a movable contact 420*f* as the movable contact 420*e* in (26C) of FIG. 26 from which the flat part 423*e* is removed and in which extension parts 424*f* extending in four respective directions are connected with the stepped part 422 and one convex part 425 is formed at each extension part 424*f*. FIG. 26 illustrates, in (26E), a plan view of a movable contact 420*g* as the movable contact 420*f* in (26D) of FIG. 26 in which the four extension parts 424*f* are replaced with three extension parts 424*g*. FIG. 26 illustrates, in (26F), a plan view of a movable contact 420*h* as the movable contact 420*c* in (26A) of FIG. 26 in which the first through-hole 426 is not provided.

Like the above-described various modifications, for example, the shape and existence of the flat part 423, the number of extension parts 424 and the shapes thereof, the number of convex parts 425 and the formation positions thereof, and the presence of the first through-hole 426 are freely changeable. Any other various modifications are applicable in addition to the exemplary modifications illustrated in FIG. 26. For example, the flat part 423*e* of the movable contact 420*e* in (26C) of FIG. 26 may have a substantially rectangular shape in plan view. For example, the first through-hole 426 does not need to be provided in the movable contact 420*f* in (26D) of FIG. 26.

The fixation sheet 430, 430*a*, or 430*b* (referred to as the fixation sheet 430 or the like) may partially or entirely cover the surface of the extension part 424, 424*d*, 424*f*, or 424*g* (referred to as the extension part 424 or the like), which faces to the substrate 440, as long as the fixation sheet 430 or the like covers at least a portion of the surface of the outer extension part of the movable contacts 420, 420*a*, 420*b*, 420*c*, 420*d*, 420*e*, 420*f*, 420*g*, or 420*h* (referred to as the movable contact 420 or the like). The foot part 413 does not need to include the first recess 414. In this case, for example, the outer extension part of the movable contact 420 or the like may be placed over a bottom surface (surface facing to the substrate 440) of the foot part 413, and the fixation sheet 430 or the like may be adhered to the surface of the outer extension part. In addition, the first recess 414 does not need to include the second recess 415. In this case, for example, the fixation sheet 430 or the like may be adhered in the manner illustrated in FIG. 25.

The operation key 410 does not need to include the dome part 412. For example, instead of the dome part 412, a thin coupling part that allows the key body 411 to move upward and downward may be provided between the key body 411 and the foot part 413. The fixation sheet 430 or the like may include the adhesion layers 434 on both surfaces of the insulating substrate 433. In this case, for example, the foot part 413 and the outer extension part may be fixed to each other with the fixation sheet 430 or the like interposed between the back surface of the foot part 413 (whether or not the first recess 414 and the second recess 415 are provided) and the outer extension part.

Various components of the pushbutton switch members 401, 401*a*, and 401*b* in the embodiments may be optionally combined with each other unless the combination is inconsistent. For example, the structures according to the sixth and seventh embodiments may be combined with each other such that the movable contact 420 does not include the convex parts 425. The structures according to the sixth and eighth embodiments may be combined with each other such that the movable contact 420 includes a protrusion corresponding to the protrusion 427 whereas the LED 443 is provided to the substrate 440. In this case, the protrusion is preferably shaped in a cylinder so that the LED 443 can be inserted into the cylinder. With this configuration, when the movable contact 420 is pushed in toward the substrate 440, the cylindrical protrusion moves downward while surrounding the LED 443 and contacts with the contacts 442, 442.

INDUSTRIAL APPLICABILITY

A pushbutton switch member according to the present invention is applicable to various instruments including an operation key, such as a mobile communication instrument, a PC, a camera, an on-board electronic device, a household audio instrument, and a household electronic product.

The invention claimed is:

1. A pushbutton switch member comprising:
a dome-shaped movable contact; and
an operation key disposed on a protrusion side of the movable contact, the operation key being opposite to and spaced apart from the movable contact, wherein
pushing the operation key toward the movable contact causes the movable contact to electrically connect at least two contacts on a substrate,
the operation key includes:
a key body;
an arcuate dome connecting to an outer periphery of the key body and deformable by pushing the key body toward the substrate, the arcuate dome being bowed outwardly from the substrate;
a foot connected with an outer periphery of the arcuate dome and fixed on the substrate; and
one or more intermediate parts between the arcuate dome and the foot, the one or more intermediate parts facing the substrate with a gap interposed therebetween, and
the movable contact includes:
an upper contact spaced apart from and disposed directly below the key body and configured to contact with a contact of the at least two contacts when the key body is pushed in; and
an outer tab disposed at the upper contact or outside of the upper contact in a radial direction and fixed outside of the key body of the operation key in the radial direction,
wherein the movable contact is disposed such that the outer fixing tab is fixed to the intermediate part of the operation key and is spaced from the substrate.

2. The pushbutton switch member of claim 1, wherein the movable contact further includes an outer contact disposed outside of the upper contact in the radial direction of the movable contact and opposite to another contact of the at least two contacts in a contact or non-contact manner, the other contact being disposed outside of the contact configured to contact with the upper contact in the radial direction, the outer contact being configured to contact with the other contact when the key body is pushed in.

3. The pushbutton switch member of claim 1, wherein the outer tab is fixed to the dome part of the operation key.

4. The pushbutton switch member of claim 1, wherein the movable contact includes a first through-hole in a region including a central part in plan view and contacts with the key body at a periphery of the first through-hole when the operation key is pushed in.

5. The pushbutton switch member of claim 4, wherein light can be transmitted through the first through-hole from an illumination means provided inside of the contacts on the substrate in the radial direction.

6. The pushbutton switch member of claim 5, wherein
the operation key includes, at a lower part of the key body, a recess in which the illumination means is housed when the key body is moved downward, and
at least a portion of the operation key is translucent.

7. The pushbutton switch member of claim 1, wherein the operation key includes, at the key body, a second through-hole penetrating from outside of the key body toward the movable contact.

8. The pushbutton switch member of claim 7, wherein a translucent material is buried partially or entirely in the second through-hole in a length direction of the second through-hole.

9. The pushbutton switch member of claim 1, wherein the operation key is made of a translucent material.

10. The pushbutton switch member of claim 5, wherein a light-shielding layer is partially provided at least on a top surface of the key body.

11. The pushbutton switch member of claim 1, wherein the key body has such a multi-layer structure that a top surface side of the key body and a movable contact side of the key body are made of materials having different hardness values.

12. The pushbutton switch member of claim 1, wherein the movable contact includes a skirt plate disposed on an outer periphery of the upper contact and on a plane different from a plane of the upper contact.

13. The pushbutton switch member of claim 12, wherein the skirt plate and upper contact are integrally connected by a step.

14. The pushbutton switch member of claim 12, wherein the outer tab extends from the skirt plate, and the movable contact includes a pair of outer tabs extending from opposite sides of the skirt plate and fixing the movable contact to the arcuate dome.

15. The pushbutton switch member of claim 1, wherein the arcuate dome has an arcuate inner surface and an arcuate outer surface, and the arcuate inner surface and the arcuate outer surface of the arcuate dome are bowed outwardly in a concave shape with respect to the substrate.

* * * * *